US009945211B2

(12) United States Patent
McNamee et al.

(10) Patent No.: US 9,945,211 B2
(45) Date of Patent: Apr. 17, 2018

(54) LEAK-OFF ASSEMBLY FOR GRAVEL PACK SYSTEM

(71) Applicants: Stephen McNamee, Rhode (IE); John S. Sladic, Katy, TX (US); Stephen Reid, Loughborough (GB); Andrew McGeoch, Loughborough (GB); Matthew Manning, Loughborough (GB); Daniel G. Purkis, Loughborough (GB)

(72) Inventors: Stephen McNamee, Rhode (IE); John S. Sladic, Katy, TX (US); Stephen Reid, Loughborough (GB); Andrew McGeoch, Loughborough (GB); Matthew Manning, Loughborough (GB); Daniel G. Purkis, Loughborough (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 592 days.

(21) Appl. No.: 14/602,438

(22) Filed: Jan. 22, 2015

(65) Prior Publication Data

US 2015/0226040 A1 Aug. 13, 2015

Related U.S. Application Data

(60) Provisional application No. 62/045,326, filed on Sep. 3, 2014, provisional application No. 62/045,329, filed on Sep. 3, 2014.

(30) Foreign Application Priority Data

Jan. 22, 2014 (GB) ..... 1401066.4

(51) Int. Cl.
*E21B 43/04* (2006.01)
*E21B 43/08* (2006.01)

(52) U.S. Cl.
CPC ..... *E21B 43/045* (2013.01); *E21B 43/08* (2013.01); *E21B 43/086* (2013.01)

(58) Field of Classification Search
CPC ..... E21B 43/267
See application file for complete search history.

(56) References Cited

U.S. PATENT DOCUMENTS 4,945,991 A 8/1990 Jones
5,113,935 A 5/1992 Jones et al.
(Continued)

FOREIGN PATENT DOCUMENTS

WO 2004/099560 A1 11/2004
WO 2010/028158 A1 3/2010
(Continued)

OTHER PUBLICATIONS

Examination Report No. 2 in corresponding AU Appl. 2015200277, dated Jun. 28, 2016, 3-pgs.
(Continued)

*Primary Examiner* — Wei Wang
(74) *Attorney, Agent, or Firm* — Blank Rome LLP

(57) ABSTRACT

A gravel pack assembly for a borehole has first and second joints and a foil. The basepipes of the joints connect end-to-end, and both of the basepipes having filters for filtering fluid passage from a borehole into bores of the basepipes. Transport tubes are disposed along the first and second joint, and a jumper tube expands across the connected ends of the basepipes and connects the transport tubes together. The foil encloses an area across the connected ends. The foil has an external surface defining an annulus thereabout with the borehole. The foil has end rings abutting the filters of the joints. At least a section of the foil leaks fluid from the borehole to the area enclosed by the foil, and at least a filter
(Continued)

portion of the assembly filters the leaked fluid from the area to at least one of the first and second bores.

27 Claims, 18 Drawing Sheets

(56) References Cited

U.S. PATENT DOCUMENTS

| | | | |
|---|---|---|---|
| 5,341,880 | A | 8/1994 | Thorstensen et al. |
| 5,515,915 | A | 5/1996 | Jones et al. |
| 5,868,200 | A | 2/1999 | Bryant et al. |
| 6,227,303 | B1 | 5/2001 | Jones |
| 6,405,800 | B1 | 6/2002 | Walker et al. |
| 6,409,219 | B1 | 6/2002 | Broome et al. |
| 7,497,267 | B2 | 3/2009 | Setterberg, Jr. et al. |
| 7,918,276 | B2 | 4/2011 | Guignard et al. |
| 7,971,642 | B2 | 7/2011 | Yeh et al. |
| 8,281,855 | B2 | 10/2012 | Langlais et al. |
| 8,919,435 | B2 | 12/2014 | Greci et al. |
| 2002/0079099 | A1 | 6/2002 | Hurst et al. |
| 2002/0189809 | A1 | 12/2002 | Nguyen et al. |
| 2004/0140089 | A1 | 7/2004 | Gunneroed |
| 2010/0059232 | A1 | 3/2010 | Langlais et al. |
| 2010/0155064 | A1 | 6/2010 | Nutley et al. |
| 2010/0236779 | A1 | 9/2010 | Nutley et al. |
| 2013/0341006 | A1 | 12/2013 | Greci et al. |
| 2014/0076580 | A1 | 3/2014 | Holderman et al. |
| 2014/0110131 | A1* | 4/2014 | Cunningham ..... E21B 43/04 166/378 |

FOREIGN PATENT DOCUMENTS

| | | | |
|---|---|---|---|
| WO | 2011/130122 | A2 | 10/2011 |
| WO | 2013/1/7878 | A1 | 12/2013 |

OTHER PUBLICATIONS

Notice of Acceptance in corresponding AU Appl. 2015200277, dated Sep. 2, 2016, 2-pgs.

First Office Action in corresponding CN Appl. 201510033331.X, dated Nov. 28, 2016, 21-pgs.

Extended Search Report in corresponding EP Appl. 151522083, dated Jul. 21, 2016, 8-pgs.

Patent Examination Report No. 1 in counterpart Austrailian Appl. 2015200277, dated Oct. 29, 2015.

Office Action for corresponding CA Patent Application No. 2,879,153; dated Feb. 8, 2016; pp. 1-5.

Weatherford, "Openhole Shunted Screen System," Brochure, copyright 2011.

Weatherford, "Shunt Tube Technology," Brochure, copyright 2011.

* cited by examiner 120b
124
125
126
128
150
154
152
151a
151
135
132
110b
123a
123b
122b
112
140a
144
142
110a 140b
149
142
110b
130
118
122a
122a
123a
124
123b
112
132
110b
151b
151b
135

LEAK-OFF ASSEMBLY FOR GRAVEL PACK SYSTEM

CROSS-REFERENCE TO RELATED APPLICATIONS

This application claims the benefit under 35 U.S.C. § 119(e) to U.S. Provisional Appl. Nos. 62/045,326, filed 3 Sep. 2014 and 62/045,329, filed 3 Sep. 2014 and claims the benefit under 35 U.S.C. §119(a) to UK Appl. 1401066.4, filed 22 Jan. 2014.

BACKGROUND OF THE DISCLOSURE

Production of hydrocarbons from loose, unconsolidated, and/or fractured formations often produces large volumes of particulates along with the formation fluids. These particulates can cause a variety of problems. For this reason, operators use gravel packing as a common technique for controlling the production of such particulates.

To gravel pack or fracture pack a completion, a screen is lowered on a workstring into the wellbore and is placed adjacent the subterranean formation or in perforated casing. Proppant, sand, or particulate material (collectively referred to as "gravel") and a carrier fluid are pumped as a slurry down the workstring. Eventually, the slurry can exit through a "cross-over" into the wellbore annulus formed between the screen and the wellbore.

The carrier liquid in the slurry normally flows into the formation and/or through the screen itself. However, the screen is sized to prevent the gravel from flowing through the screen. This results in the gravel being deposited or "screened out" in the annulus between the screen and the wellbore to form a gravel-pack around the screen. The gravel, in turn, is sized so that it forms a permeable mass (i.e., a gravel pack) that allows produced fluids to flow through the mass and into the screen but blocks the flow of particulates into the screen.

Due to poor distribution, it is often difficult to completely pack the entire length of the wellbore annulus around the screen so that an interval in the annulus is not completely gravel packed. This poor distribution of gravel is often caused by the carrier liquid in the slurry being lost to the more permeable portions of the formation. Due to the loss of the carrier liquid, the gravel in the slurry forms "sand bridges" in the annulus before all of the gravel has been placed around the screen. Such bridges block further flow of the slurry through the annulus, thereby preventing the placement of sufficient gravel below the bridge in top-to-bottom packing operations or above the bridge in bottom-to-top packing operations.

Alternate flow conduits, called shunt tubes, can alleviate this bridging problem by providing a flow path for the slurry around such sections that tend to form sand bridges. The shunt tubes are typically run along the length of the wellscreen and are attached to the screen by welds. Once the screen assemblies are joined, fluid continuity between the shunt tubes on adjacent screen assemblies must be provided, and several techniques have been developed to provide such continuity.

FIGS. 1A-1B are schematic views of examples of sand screens 18*a-b* provided with shunt tubes 30*a-b* of a wellscreen assembly 10. FIG. 2A illustrates an exploded view of the components for the wellscreen assembly 10 for use in an open hole. As an alternative, FIG. 2B illustrates an exploded view of components for the wellscreen assembly 10 for use in a cased hole.

In the assembly 10, a first sand control device 12*a* is coupled to a second sand control device 12*b*, and each device 12*a-b* has basepipe joints 14 joined together to define a production bore 16. Screens 18*a-b* having filter media surround the basepipe joints 14 and are supported by ribs 19. The assembly 10 is provided with shunt tubes 30*a-b*, which in this example are steel tubes having substantially rectangular cross-section. The shunt tubes 30*a-b* are supported on the exterior of the screens 18*a-b* and provide an alternate flow path 32.

To provide fluid communication between the adjacent sand control devices 12*a-b*, jumper tubes 40 are disposed between the shunt tubes 30*a-b*. In this way, the shunt tubes 30*a-b* and the jumper tubes 40 maintain the flow path 32 outside the length of the assembly 10, even if the borehole's annular space B is bridged, for example, by a loss of integrity in a part of the formation F.

Additional examples of shunt tube arrangements can be found in U.S. Pat. Nos. 4,945,991 and 5,113,935. The shunt tubes may also be internal to the filter media, as described in U.S. Pat. Nos. 5,515,915 and 6,227,303.

As shown in FIGS. 1A-1B and 2A, the assembly 10 for an open hole completion typically has main shrouds 28*a-b* that extend completely over the sand control devices 12*a-b* and provides a protective sleeve for the filter media and shunt tubes 30*a-b*. The shrouds 28*a-b* have apertures to allow for fluid flow. The main shrouds 28*a-b* terminate at the end rings 20*a-b*, which supports ends of the shrouds 28*a-b* and have passages for the ends of the shunt tubes 30*a-b*. For a cased hole completion, the assembly 10 as shown in FIG. 2B may lack shrouds.

Either way, the shunt tubes 30*a-b* stop a certain length from the ends of the sand control devices 12*a-b* to allow handling room when the devices 12*a-b* are joined together at the rig. Once the devices 12*a-b* are joined, their respective shunt tubes 30*a-b* are linearly aligned, but there is still a gap between them. Continuity of the shunt tubes' flow path 32 is typically established by installing the short, pre-sized jumper tubes 40 in the gap.

Each jumper tube 40 has a connector 50 at each end that contains a set of seals and is designed to slide onto the end of the jumper tube 40 in a telescoping engagement. When the jumper tube 40 is installed into the gap between the shunt tubes 30*a-b*, the connectors 50 are driven partially off the end of the jumper tube 40 and onto the ends of the shunt tube 30*a-b* until the connectors 50 are in a sealing engagement with both shunt tubes 30*a-b* and the jumper tube 40. The shunt tubes' flow path 32 is established once both connectors 50 are in place. A series of set screws (not shown) can engage both the jumper tube 40 and adjoining shunt tube 30*a-b*. The screws are driven against the tube surfaces, providing a friction lock to secure the connector 50 in place.

This connection may not be very secure, and there is concern that debris or protruding surfaces of the wellbore can dislodge the connectors 50 from sealing engagement with the tubes 30*a-b* and 40 while running the wellscreen assembly 10 into the wellbore. Therefore, a device called a split cover 22 as shown in FIG. 1A is typically used to protect the connectors 50. The split cover 22 is a piece of thin-gauge perforated tube, essentially the same diameter as the main shrouds 28*a-b* of the screen assembly 10, and the same length as the gap covered by the jumper tubes 40. The perforated cover 22 is spit into halves with longitudinal cuts, and the halves are rejoined with hinges along one seam and with locking nut and bolt arrangements along the other seam. The split cover 22 can be opened, wrapped around the gap area between the sand control devices 12*a-b*, and then closed and secured with the locking bolts.

Typically, the split cover 22 is perforated with large openings that do not inhibit movement of the gravel and slurry. Primarily, the split cover 22 acts as a protective shroud so that the assembly 10 does not get hung up on the end rings 20*a-b* when running in hole or so the jumper tubes 40, connectors 50, and shunt tubes 30*a-b* are not damaged during run in.

As can be seen above, proppant or gravel in gravel pack or frac pack operations is placed along the length of a sand face completion whether it is open hole or cased hole. To place the gravel in a gravel pack operation, the carrier fluid carries the gravel to the sand face to pack the void space between the sand face and the sand screen. In a frac pack operation, the carrier fluid carriers the gravel to fracture the reservoir rock and to increase the sand face/gravel contact area. Then, the annular space is packed with the gravel between the cased or open hole and the sand screen.

To leave a fully supported gravel pack in the annulus, the carrier fluid dehydrates and leaves the gravel in a fully supported position. Depending on the operation, dehydration occurs through the reservoir sand face into the reservoir and/or through the sand screens 18*a-b* and up the wellbore. When fluid dehydrates through the sand screens 18*a-b*, there must be an adequate open area that provides access to flow paths allowing the carrier fluid to return up the well.

Most sand screen assemblies 10 have blank areas or gaps near the basepipe connections where the sand screens 18*a-b* are made up when running in hole. These blank areas on the sand screen assemblies provide no open area for fluid dehydration. Consequently, gravel pack settling is unstable in these blank areas, creating unstable pack sections around the sand screens' blank area having voids or space. Gravel that has been packed uphole might eventually migrate or shift due to fluid flow and gravity. This shifting can expose sections of the screen and may lead to a loss of sand control.

During gravel packing of the assemblies of FIGS. 1A-1B and 2A-2B, gravel slurry can readily communicate around the blank area between the end rings 20*a-b* on the basepipes 14. For example, the slurry can readily enter through the shroud 22 and can collect in the blank area between the end rings 20*a-b* around the basepipes 14. The slurry becomes trapped in the blank area because the gravel cannot dehydrate and the carrier fluid cannot return uphole. To deal with this, a leak-off tube 34 can be positioned in this blank area between the end rings 20*a-b*. The leak-off tube 34 has openings (not shown) along it that allow the carrier fluid to enter from the slurry in the blank area so the gravel can dehydrate.

Although the leak-off tube may be effective to an extent to dehydrate slurry in the blank area, better distribution of gravel is desired in both open and cased holes to improve sand control. To that end, the subject matter of the present disclosure is directed to overcoming, or at least reducing the effects of, one or more of the problems set forth above.

SUMMARY OF THE DISCLOSURE

As disclosed herein, a gravel pack assembly for a borehole has first and second joints and a foil. The basepipes of the joints connect end-to-end, and both of the basepipes having filters for filtering fluid passage from the borehole into bores of the basepipes. Transport tubes are disposed along the first and second joints. After the joints are connected, a jumper tube expands across the connected ends of the basepipes and connects the transport tubes together. Then, the foil is disposed over the connected ends of the joints and encloses a blank area across the connected ends. The foil has an external surface defining an annulus thereabout with the borehole, and the foil has end rings abutting the filters of the joints.

To provide leak off in the blank area, at least a section of the foil leaks fluid from the borehole to the area enclosed by the foil, and at least a filter portion of the assembly filters the leaked fluid from the blank area to at least one of the first and second bores.

In one embodiment, a gravel pack assembly for a borehole has tubing having a bore and having first and second joints coupled together at first and second ends. A first filter is disposed on the first joint and filters fluid passage from the borehole into the bore, and a second filter is disposed on the second joint and filters fluid passage from the borehole into the bore. A foil abuts the first and second filters and encloses a blank area across the first and second coupled ends. The foil has an external surface defining an annulus thereabout with the borehole. The foil at least leaks fluid from the borehole to the blank area enclosed by the foil, and a filter portion of the assembly filters the leaked fluid of the blank area to the bore of the tubing.

The first and second screens can filter returns from slurry in the borehole and hold gravel from the slurry in the annulus, and the external surface of the foil can provide a uniform outer dimension against which the gravel can be held in the annulus.

The assembly can have one or more transport tubes disposed along the tubing, and a jumper tube can be disposed inside the blank area enclosed by the foil and can connect the first and second transport tubes together.

In one arrangement, an end ring of the foil can define a passage communicating the fluid from the blank area to a space between the filter and the basepipe of the tubing. At least a portion of the foil can have a screen filtering the fluid leaked from the borehole into the blank area enclosed by the foil.

In another arrangement, the foil can enclose one or more perforations on at least end of a joint of the tubing. A filter portion of the assembly can then filter the leaked fluid of the blank area directly to the one or more perforations. For example, at least one section of the foil can filter the fluid leaked from the borehole into the blank area enclosed by the foil. Alternatively, a filter can be disposed in the blank area and can filter the leaked fluid from the blank area directly to the one or more perforations defined in the first end. In yet another alternative, a part of the filter on one end of the joints can be enclosed in the blank area by the foil. In this way, the enclosed filter portion can filter the leaked fluid from the blank area directly to the one or more perforations defined in the first end of the first joint.

In another embodiment, a method of assembling a gravel pack assembly for a borehole involves assembling tubing by connecting a first end of a first joint to a second end of a second joint, and enclosing a blank area across the first and second connected ends by fitting a foil over the first and second connected ends. The method involves abutting a first portion of the foil against a first filter on the first joint; and abutting a second portion of the foil against a second filter on the second joint. The method involves permitting fluid communication from outside the foil through a section of the foil to the blank area enclosed by the foil, and permitting filtering of the fluid communication from the blank area to a bore of the tubing.

In yet another embodiment, a method of gravel packing a borehole involves conducting slurry in an annulus of a borehole around tubing having first and second joints coupled together at first and second ends; filtering fluid from the slurry in the borehole to the bore of the tubing though first and second filters disposed on the first and second joints; and foiling the slurry in the annulus around a foil extending across a blank area between the first and second coupled ends. The method involves leaking the fluid from the slurry in the borehole through the foil and into the blank area and filtering the fluid from the blank area to the bore of the tubing.

The foregoing summary is not intended to summarize each potential embodiment or every aspect of the present disclosure.

DETAILED DESCRIPTION OF THE DISCLOSURE

Figure 1A:
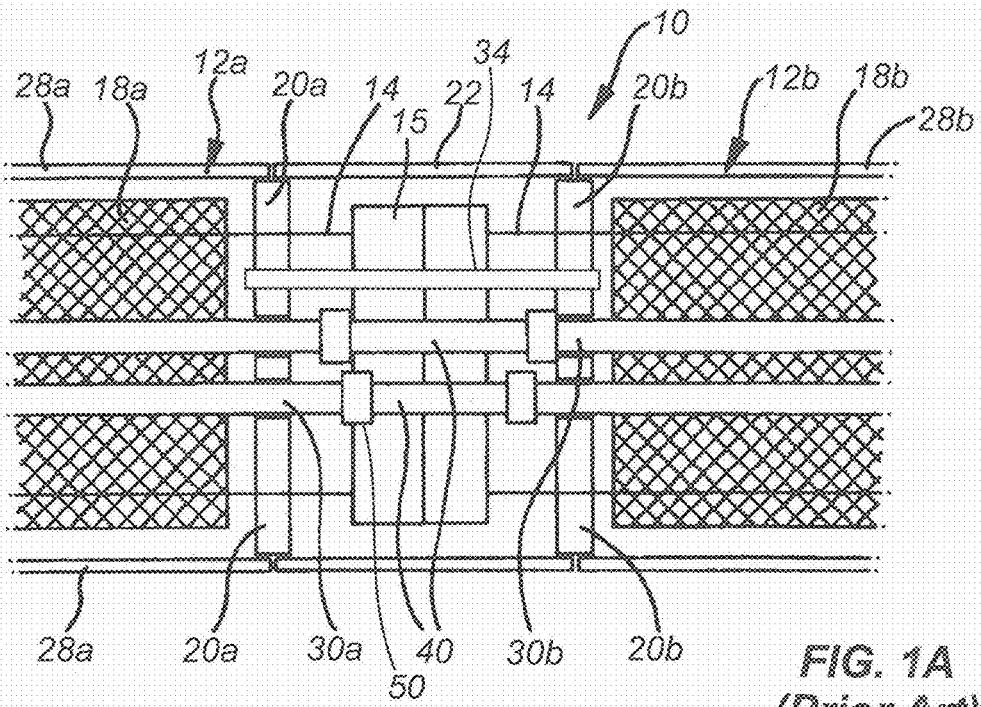
FIG. 1A (Prior Art)
FIG. 1A illustrates a side view of an open hole wellscreen assembly according to the prior art for an open hole.
Figure 1B:
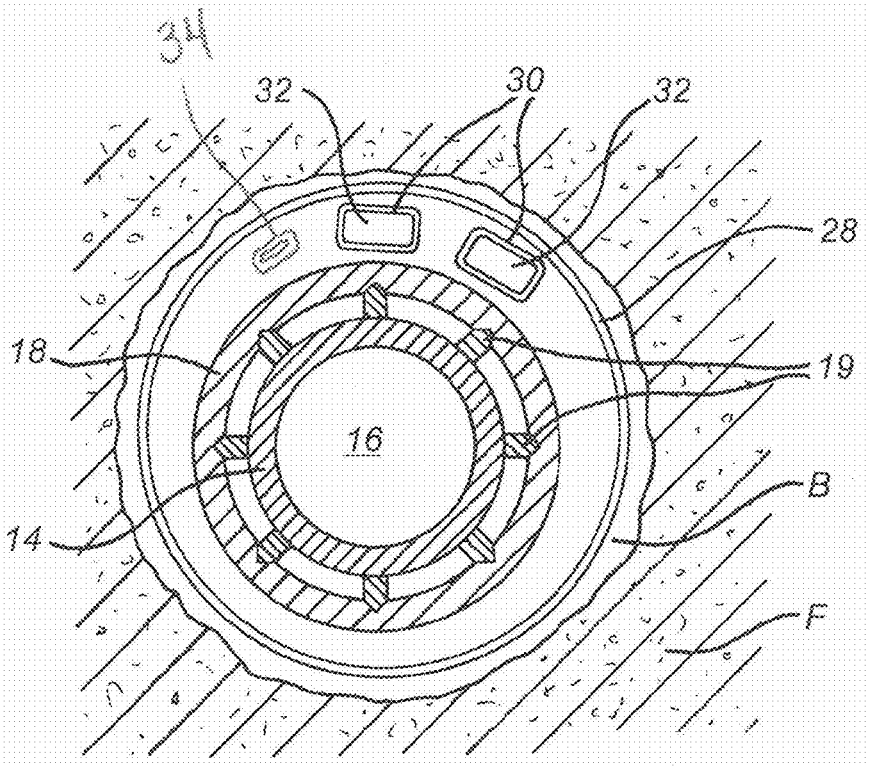
FIG. 1B (Prior Art)
FIG. 1B illustrates an end view of the open hole wellscreen assembly of FIG. 1A.
Figure 2A:
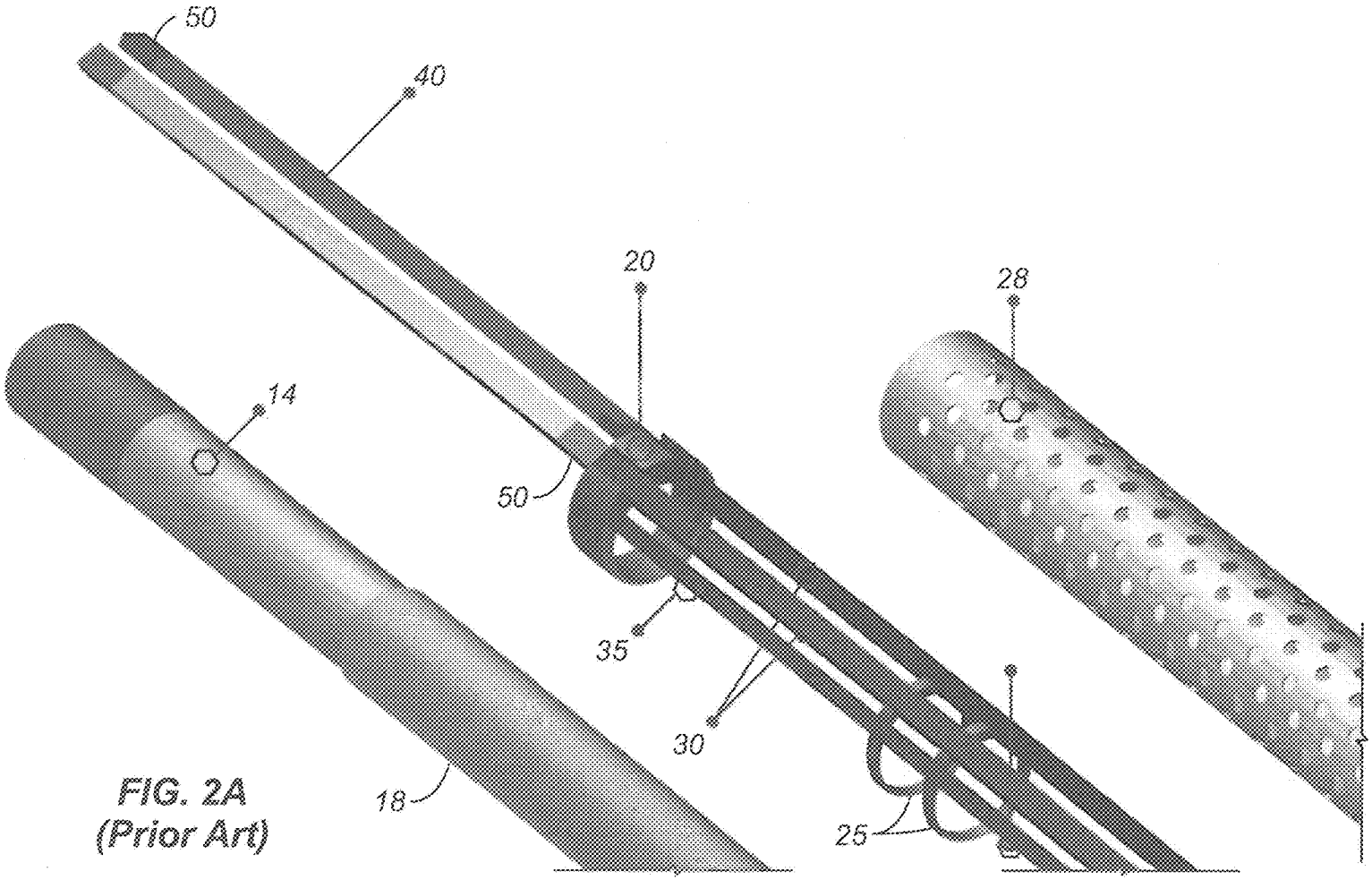
FIG. 2A (Prior Art)
FIG. 2A illustrates an exploded view of the components for the open hole wellscreen assembly of FIG. 1A.
Figure 2B:
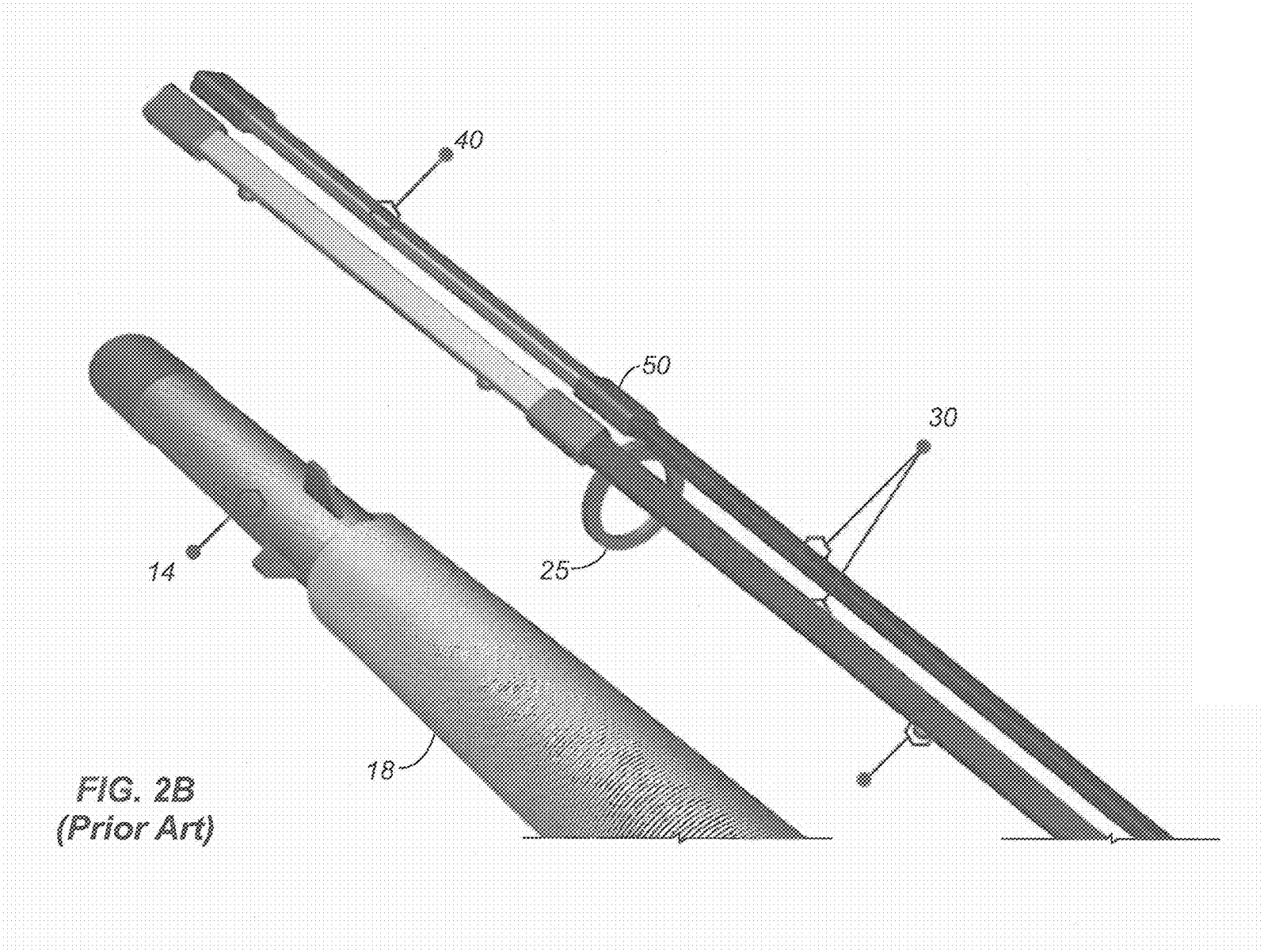
FIG. 2B (Prior Art)
FIG. 2B illustrates an exploded view of components for a cased hole wellscreen assembly.
Figures 3A, 3B:
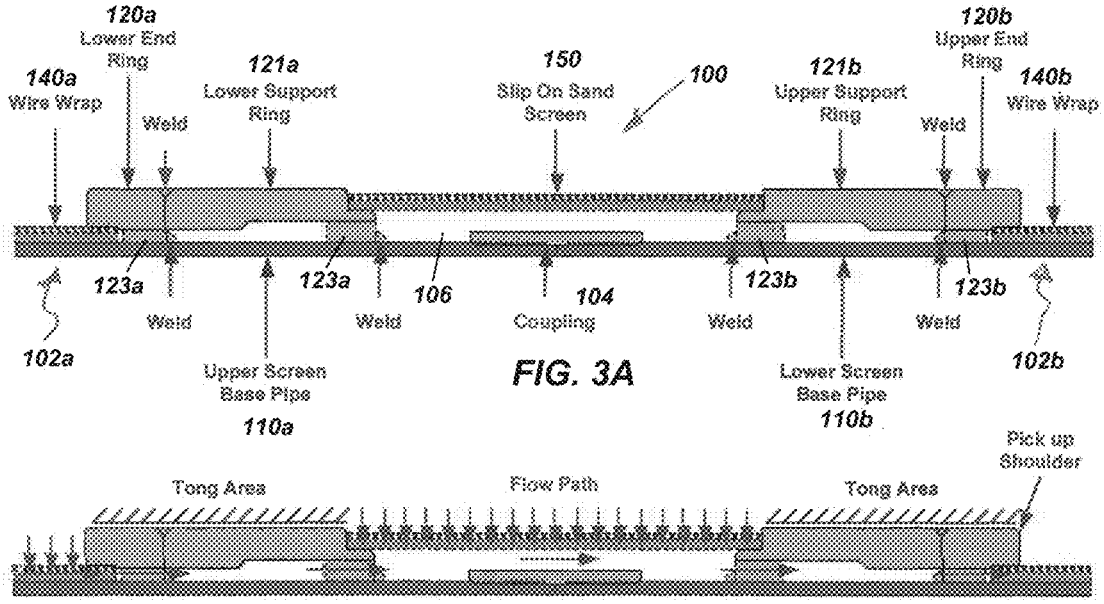
FIGS. 3A-3B illustrate longitudinal cross-sectional views of a wellscreen assembly according to a first embodiment of the present disclosure.

Referring to FIGS. 3A-3B, a first wellscreen assembly 100, such as a downhole/sand screen assembly, has first and second joints or screen sections 102*a-b* longitudinally coupled together. As best shown in FIG. 3B, a fluid flow path P is between the first and second screen sections 102*a*, 102*b*. Preferably, the fluid flow path P is annular.

The first screen section 102*a* comprises a first basepipe 110*a* with a first screen or filter 140*a* disposed thereon. The second screen section 102*b* comprises a second basepipe 110*b* with a second screen or filter 140*b* disposed thereon. The first and second basepipes 110*a-b* are coupled by a coupling 104, i.e. a threaded coupling.

The first and second screens 140*a-b* are coupled by first and second rings 120*a*, 121*a* and 120*b*, 121 *b*. Additionally, a foil 150 in the form of a filter or screen is disposed in the blank area between end rings and interconnects the two screens 140*a-b*. In particular, ends of the foil 150 extend to support rings 121*a-b* disposed on the basepipes 110*a-b*. End rings 120*a-b* are connected outside the support rings 121*a-b* and connect to the separate screens 140*a-b* by overlapping a portion thereof.

In this arrangement, the foil 150, which can be a short extent of wire-wrapped screen, slips on the ends of the basepipes 110*a-b* and is trapped between the support rings 121*a-b* as the two joints are torqued together. This create the void space or blank area 106 bypassing the coupling 104. This blank area 106 connects the flow path P beneath the end rings 120*a-b* and support rings 121*a-b* on the adjacent joints 102*a-b* and also allows fluid to pass through the foil 150 into this area 106.

The foil 150 provides a leak-off path for the assembly 100 when used in gravel pack and frac pack operations. The foil 150 forms a tubular leak-off sleeve affixed after the basepipes 102*a-b* are made up between the adjoining screen sections 102*a-b*. The end rings 120*a-b*, 121*a-b* on one or both ends may have passages or flutes 123*a-b* at the basepipe 110*a-b* for fluid to pass from inside the leak-off foil 150 to underneath the adjoining screen 140*a-b* and eventual passage through the basepipes' perforations (not shown) and up the basepipe's bores.

In particular, the foil 150 with its screen leaks (and filters) fluid flow from outside the assembly 100 to inside the blank area 106 enclosed by the foil 150. Although the entire extent of the foil 150 may include a screen, this is not strictly necessary. From inside the blank area 106, the leaked fluid can pass through the ring's flutes 123*a-b* to a space between one or both of the screens 140*a-b* and respective basepipe 110*a-b*.

At each end, multiple rings 120*a-b*, 121*a-b* can be provided for assembly purposes, and they can be welded as shown. Additionally, the end rings 120*a-b*, 121*a-b* can provide an area for tongs or other implements to engage the tubular for handling during operations.

Figure 4:
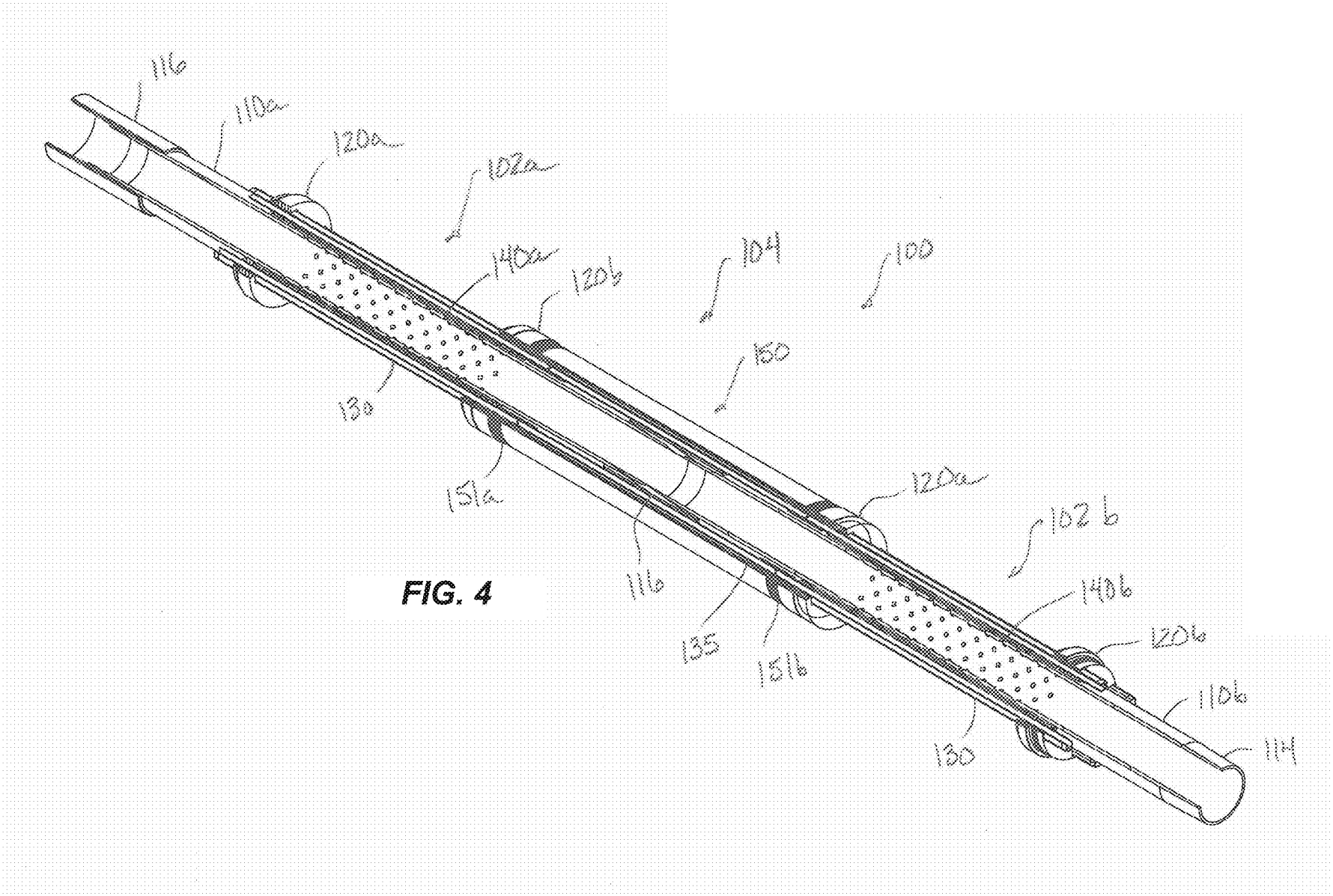
FIG. 4 is a perspective view of a wellscreen assembly according to a second embodiment of the present disclosure shown in partial cross-section.
Figure 5:
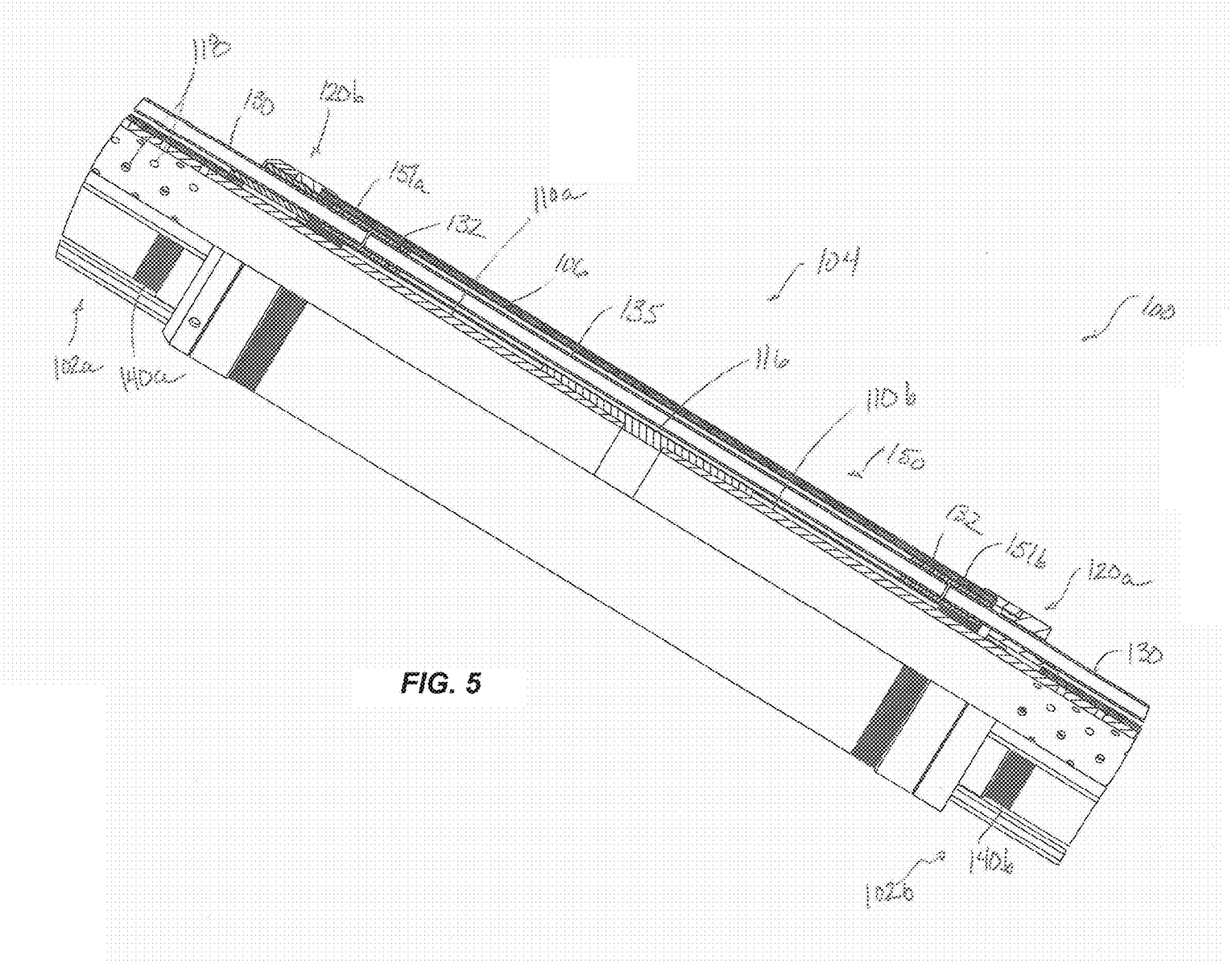
FIG. 5 is a close up view of the second wellscreen assembly shown in partial cross-section.

FIG. 4 is a perspective view of a wellscreen assembly 100 according to the present disclosure shown in partial cross-section, and FIG. 5 is a close up view of a coupling 104 between two joints or screen sections 102*a-b* of the disclosed assembly 100 shown in partial cross-section. Each joint or screen section 102*a-b* has a basepipe 110*a-b* with a screen or filter 140*a-b* disposed thereon. Threaded ends 114 on the basepipes 110*a-b* couple together with a coupling member 116 to join the screen sections 102*a-b* together at the coupling 104. Typically, the assembly 100 has multiple screen sections 102 connected in series by the couplings 104 to form a completion string for use in a cased or open borehole (not shown).

The screen or filter 140*a-b* can include any type of filter media for use downhole, including metal mesh, pre-packed screens, protective shell screens, expandable sand screens, or screens of other construction. As shown, the screen 140*a-b* can be a wire-wrapped screen having wire 144 wrapped about longitudinal ribs 144 running along a length of the basepipe 110*a-b*. The screens 140*a-b* filter fluid from the borehole directly to perforations or openings 118 in the basepipes 110*a-b* communicating with the basepipe's bores 112, which make up the overall tubing's bore.

Shunt or transport tubes 130 run along the length of the screens 140*a-b* and deliver or transport slurry in an alternate path during gravel pack or frack pack operations. End rings 120*a-b* support the transport tubes 130 at the opposing ends of the screens 140*a-b* and hold the shunt tubes 130 in place. Ends of the transport tubes 130 extend from the end rings 120*a-b*, and jumper tubes 135 interconnect to the ends of the transport tubes 130 on the adjoining screen sections 102*a-b* across the coupling 104. Connectors 132 having seals 134 connect the ends of the jumper tube 135 with the ends of the transport tubes 130.

Figure 6:
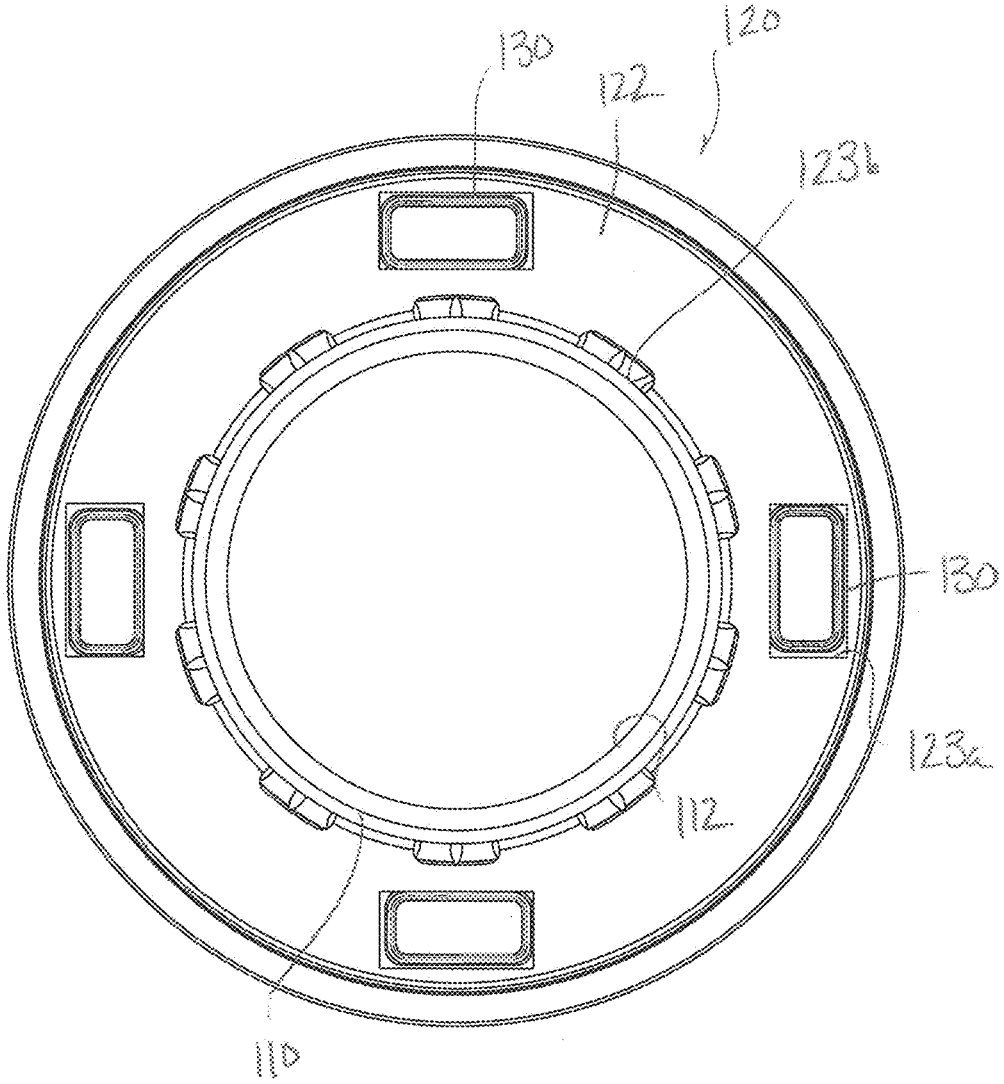
FIG. 6 is an end-view of an end ring disposed on a basepipe and having shunt tubes passing therein for the second assembly.

In general, the assembly 100 can have any number of transport tubes 130, and the tubes 130 can be used to deliver slurry out of nozzles (not shown) on the tubes 130 or may transport the slurry further along the assembly 100 to other locations. As shown in the end view of FIG. 6, the end ring 120 can support a number (e.g., four) of the transport tubes 130 about the circumference of the basepipe 110.

As best shown in FIGS. 4-5, between the end rings 120*a-b* and spanning across a blank area 106 of the coupling 104, the assembly 100 has a foil 150 covering the blank ends 114 of the basepipes 110*a-b* between the end rings 120*a-b* where the coupling member 116 connects the basepipes 110*a-b*. The foil 150 at least partially includes one or more screen sections 151*a-b*, which are shown here adjacent the end rings 120*a-b*. Other arrangements can be used.

As best shown in FIG. 5, these screen sections 151*a-b* can have ribs 152 with wire 154 wrapped thereabout, although other forms of filters or screens can be used. Additionally, both ends of the foil 150 may not require a screen section 151*a-b* as shown. Instead, one screen section 151 may be provided at one end or elsewhere along the foil 150. Additionally, more screen sections 151 can be provided on the foil 150. In fact, the entire foil 150 may constitute a screen section.

The foil 150 provides a leak-off path for the assembly 100 when used in gravel pack and frac pack operations. The foil 150 forms a tubular leak-off sleeve affixed after the basepipe connections 104 are made up between the adjoining screen sections 102*a-b*, and the jumper tubes 135 have been installed. Either one or both of the end rings 120*a-b* may have passages or flutes 123*b* at the basepipe 110*a-b* for fluid to pass from inside the leak-off foil 150 to underneath the screen 140*a-b* and eventual passage through the basepipes' perforations 118 and up the bores 112.

In particular, the foil 150 with its screen sections 151*a-b* leaks (and filters) fluid flow from outside the assembly 100 to inside the blank area 106 enclosed by the foil 150. Although the entire extent of the foil 150 may include such screen sections, this is not strictly necessary. Instead, the foil 150 can include an outer housing or sleeve 156 running along the majority of the foil 150. Either way, from inside the blank area 106, the leaked fluid can pass through the ring's flutes 123*b* to a space between one or both of the screens 140*a-b* and respective basepipe 110*a-b*.

To control leak-off and production, the screening provided by the foil 150 can be the same as or different from the screening provided by the joint's screens 140*a-b*, which are to be used for production. In this regard, the filter sections 151*a-b* of the foil 150 may be wire-wrapped screen or the like and may have gaps or slots to prevent passage of gravel. However, the size of the wire, the number of gaps, the number of slots, etc. may be less than used on the production screens 140*a-b*. Alternatively, the amount of surface area for screening provided by the foil 150 may be configured to be less than provided by the production screens 140*a-b*. In this way, using any of these various differences, the foil 150 can provide leak-off capabilities during gravel pack operations, but wellbore fluids would tend to flow more preferentially through the pipe's screens 140*a-b* during production operations due to the greater amount of open surface area of the screens 140*a-b*. Other configurations can be used and can be configured for a particular implementation.

Figures 7A, 7B:
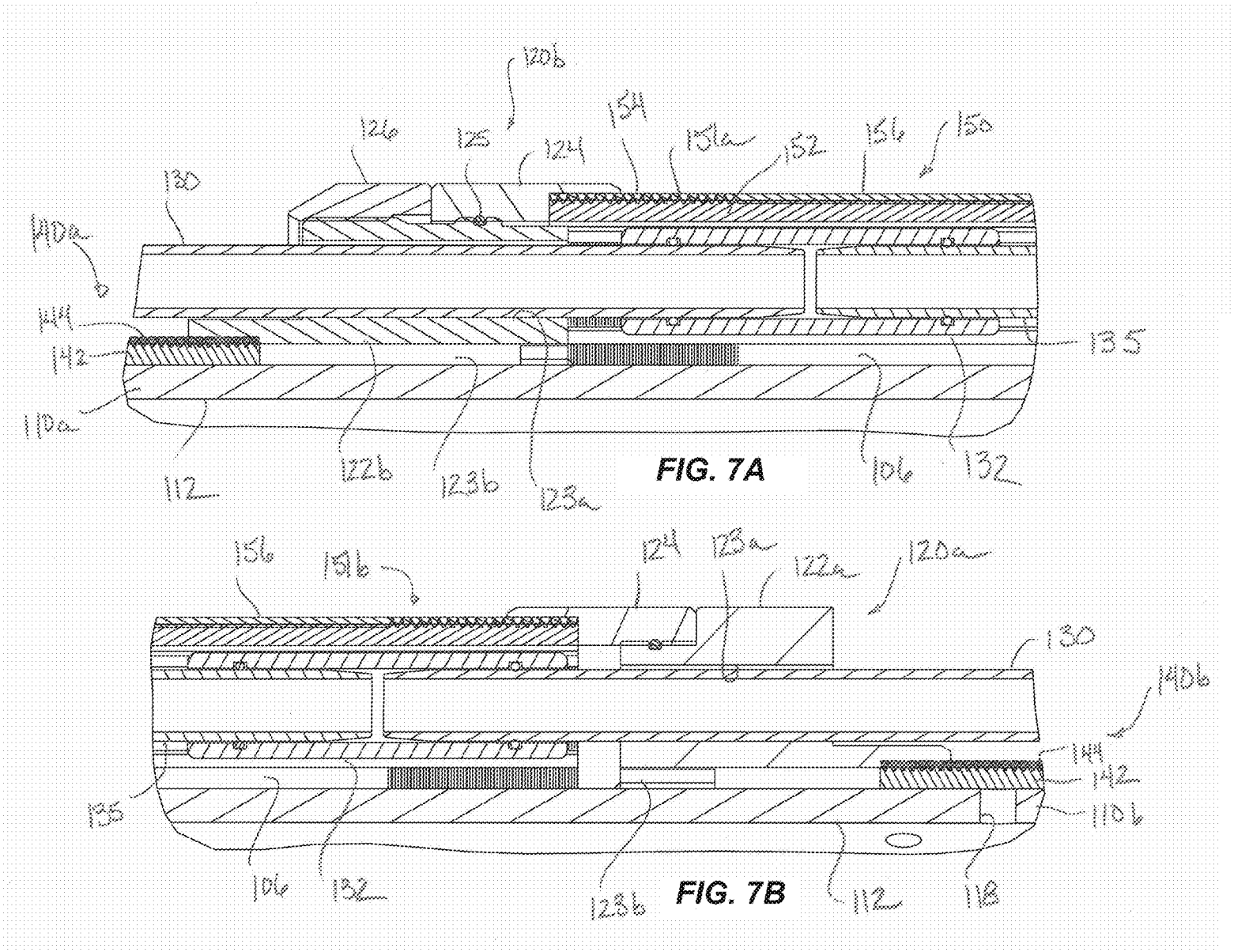
FIG. 7A is a detail of a first end ring and foil connection for the second assembly shown in cross-section.
FIG. 7B is a detail of a second end ring and foil connection for the second assembly shown in cross-section.

One (lower) end ring 120*b* at one end of the blank area 106 is shown in FIG. 7A, while the other (upper) end ring 120*a* at the other end of the blank area 106 is shown in FIG. 7B. The lower end ring 120*b* as in FIG. 7A includes an end wall 122*b* disposed about the basepipe 110*a*. The end wall 122*b* can be affixed to the basepipe 110 with welding or the like, as part of the assembly process or the joint. The end wall 122*b* has openings 123*a* for passage of the ends of the transport tubes 130. The openings 123*a* for tubes 130 may have seals (not shown), brazed material, tight clearance fits, or the like to prevent fluid communication.

The end wall 122*b* also includes inner slots or flutes 123*b* for passage of leaked fluid. The end wall 122*b* overlaps portion of one of the screens 140*a*, fitting on a portion of the wire 144 and ribs 142. Fluid can pass from the screen section 151*a* into the blank area 106 enclosed by the foil 150 and can then pass indirectly along the basepipe 110*a* to the space under the screen 140*a* via the inner slots or flutes 123*b* on the end ring 120*b*.

To hold the end of the foil 150 on the end wall 122*b*, a retention ring 124 threads (or otherwise affixes) onto the end wall 122*b* and seals with a seal 125. An end of the retention ring 124 fits over the screen section 151*a* of the foil 150. The retention ring 124 is held tight against the foil 150 using a securing ring 126 that threads (or otherwise affixes) onto the other end of the end wall 122*b* and abuts the retention ring 124. This arrangement of rings 124, 126 allows the foil 150 to be slid over the end wall 122*b* and then securing in place.

As shown in FIG. 7B, the upper end ring 120*a* at the other end of the blank area 106 is similar to the lower end ring 120*b*. This upper end ring 120*a* includes an end wall 122*a* disposed about the basepipe 110*b*, and the end wall 122*a* can be affixed to the basepipe 110 with welding or the like, as part of the assembly process or the joint. To hold the end of the foil 150 on this end wall 122*a*, a retention ring 124 threads (or otherwise affixes) onto the end wall 122*a* and seals thereagainst with a seal 125. This arrangement allows the end of the foil to be pushed up against the end wall 122*a* during assembly and secured with the retention ring 124.

The end wall 122*a* has openings 123*a* for passage of the opposite ends of the transport tubes 130. The end wall 122*a* also includes inner slots or flutes 123*b* for passage of leaked fluid. The end wall 122*a* overlaps portion of the other screen 140*b*, fitting on a portion of the wire 144 and ribs 142. Fluid can pass through the screen section 151*b* into the blank area 106 enclosed by the foil 150 and can then indirectly pass along the basepipe 110*b* to the space under the screen 140*b* via the inner slots or flutes 123*b* on the end ring 120*a*.

Figure 8:
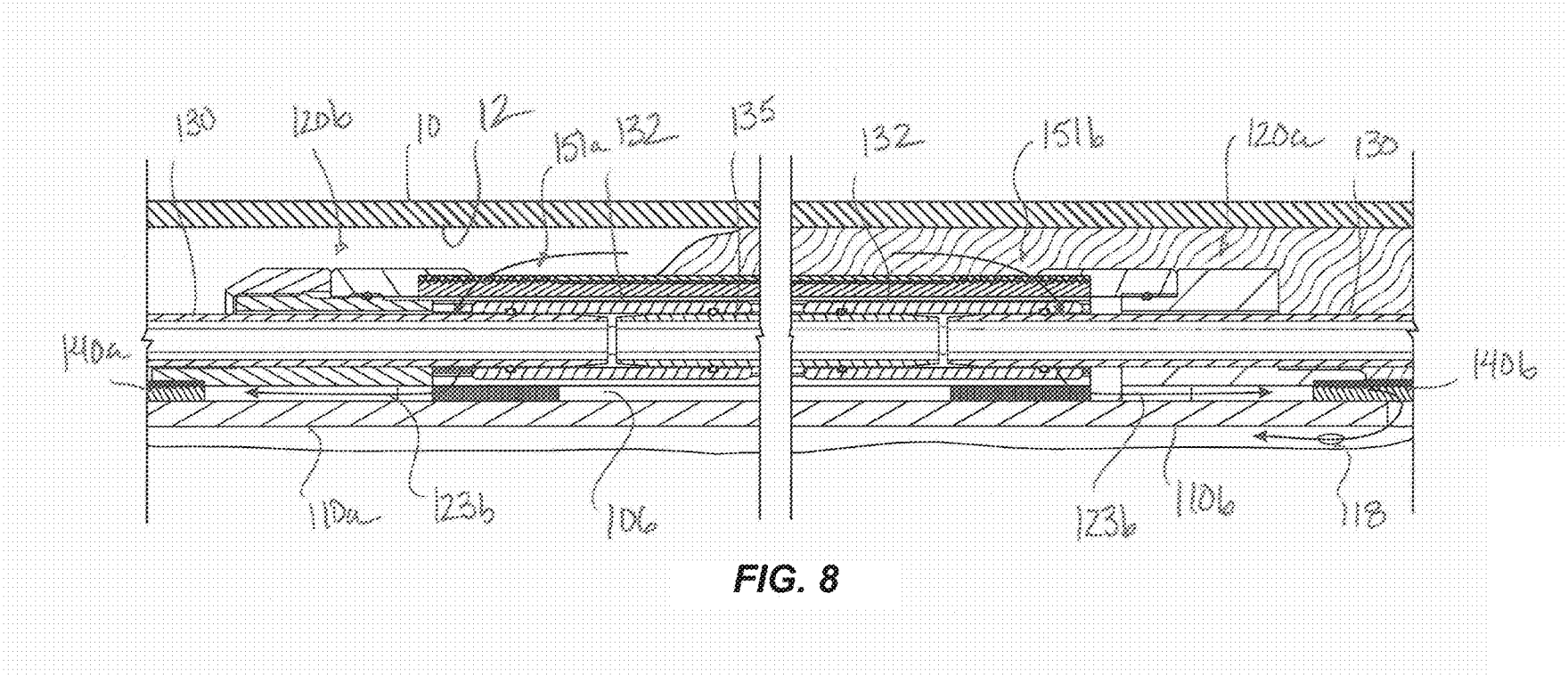
FIG. 8 illustrates the second assembly disposed in a cased hole with gravel packed in the annulus.

FIG. 8 illustrates the disclosed assembly 100 disposed in a cased hole 10 with gravel packed in the annulus. Gravel, proppant, or the like (G) is being packed in the annulus 12 between the assembly 100 and the casing 10. As the slurry travels in the annulus, the return fluid leaks off through the screens 140*a-b* to pack the gravel G about the screens 140*a-b*.

As shown, the foil 150 covers the blank connection between the basepipes 110*a-b*. The foil 150 provides a positive seal to both ends of the screens 140*a-b* and provides a surface to hold or retain the gravel G in the annular space 12 between the foil 150 and the casing 10. Internally, the foil 150 provides an open area 106 with minimal pressure drop to allow fluid to pass by the foil 150 and through the end rings 120*a-b* to below the screen 140*a-b* but outside the basepipe 110.

The assembly 100 provides more open area for the gravel G to dehydrate. Additionally, the foil 150 provides an external tubular wall on the assembly 100 that can help the gravel packing to be more uniform at the coupling 104. This external tubular wall of the foil 150 may be concentric or eccentric to the screens 140 and to the surrounding casing 10. Either way, the external tubular wall of the foil 150 provides a consistent annular space 12 to fill with gravel G with reduced variations that could cause premature bridging in the casing 10. In this way, the foil 150 provides a secondary sand control function for the standard screens 140*a-b*.

During operations to make up the toolstring and run the second assembly 100 of FIGS. 4-8 downhole, operators connect the upper basepipe 110*a* to the lower basepipe 110*b*, which already have the screens 140*a-b* and end rings 120*a-b*. Operators make up the coupling 104 by connecting the ends 114 of the basepipes 110*a-b* together with the coupling member 116 using the blank portions of the basepipes 110*a-b* for handling. Operators then position the jumper tubes 135 and connectors 132 in the blank area 106 to interconnect the shunt tubes 130.

At this point, the foil 150, which was been held over the upper screen 140*a* on the upper basepipe 110*a*, is slid down over the coupling 104 to enclose the blank area 106. The lower end of the foil 150 engages the upper end ring 120*a* of the lower joint 102*b* and seals therewith. Operators then affix the upper end of the foil 150 in place with the retention ring 126 on the lower end ring 120*b* of the upper joint 102*a*. The next and subsequent couplings 104 between joints 102 for the completion string can then be made up and run in the same way.

Figure 9:
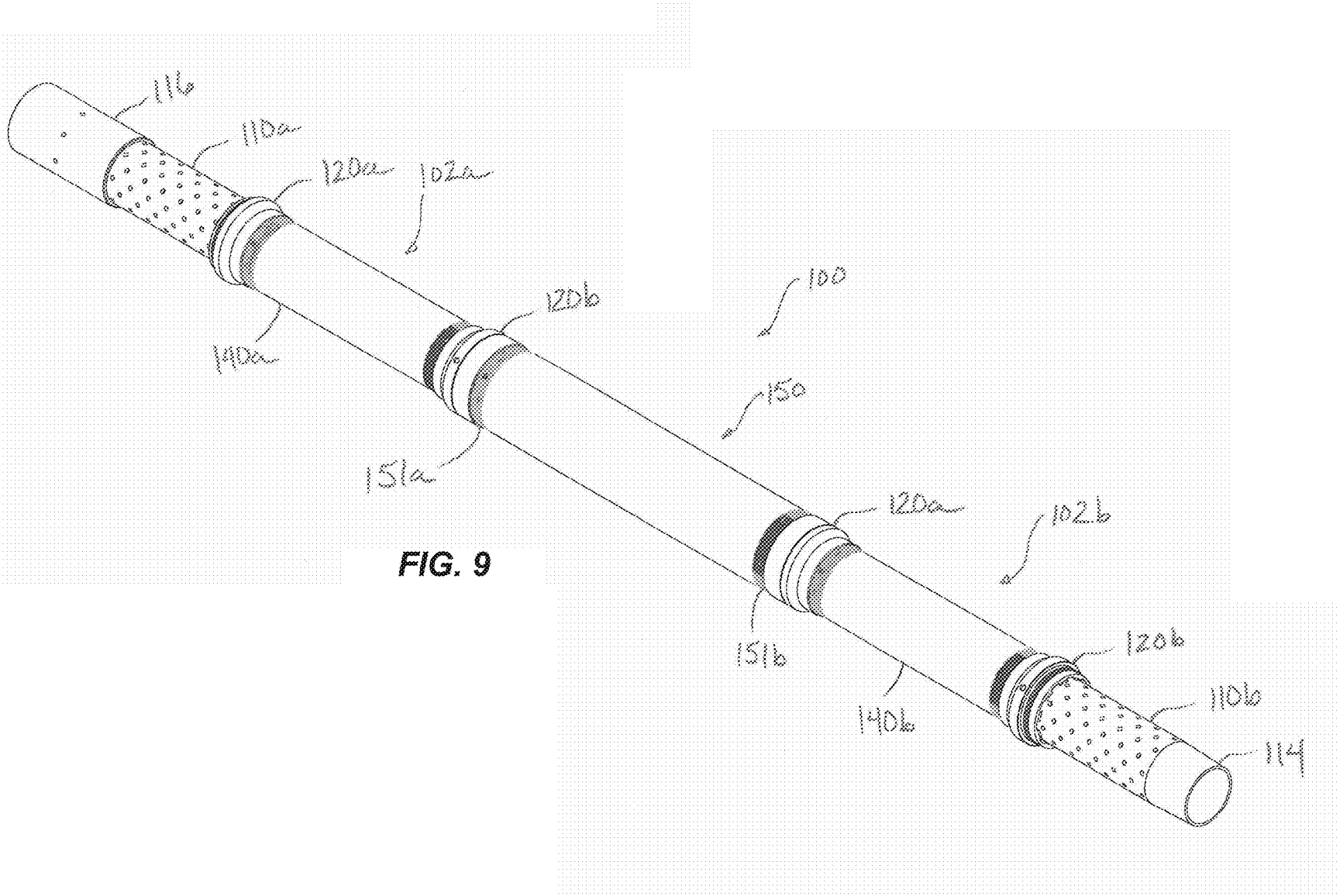
FIG. 9 is a perspective view of a wellscreen assembly according to a third embodiment of the present disclosure.
Figure 10:
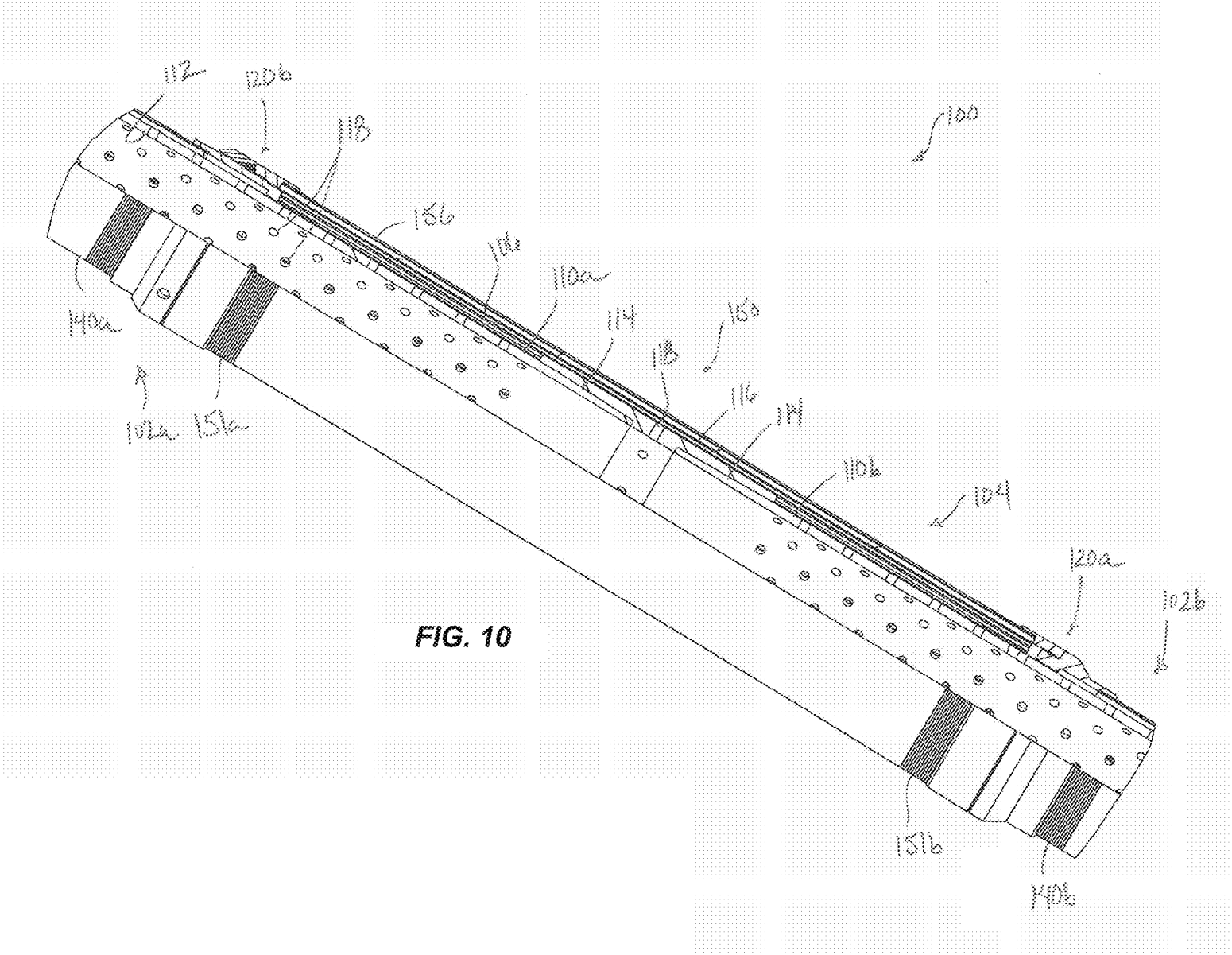
FIG. 10 is a close up view of the third assembly shown in partial cross-section.

FIG. 9 is a perspective view of a third wellscreen assembly 100 according to the present disclosure, and FIG. 10 is a close up view of a coupling 104 between two joints or screen sections 102*a-b* of the disclosed assembly 100 shown in partial cross-section. Each joint or screen section 102*a-b* has a basepipe 110*a-b* with a screen or filter 140*a-b* disposed thereon. Threaded ends 114 on the basepipes 110*a-b* couple together with coupling members 116 to join the screen sections 102*a-b* together at the coupling 104. Typically, the assembly 100 has multiple screen sections 102 connected in series by the couplings 104 to form a completion string for use in a cased or open borehole (not shown).

The screen or filter 140*a-b* can include any type of filter media for use downhole, including metal mesh, pre-packed screens, protective shell screens, expandable sand screens, or screens of other construction. As shown, the screen 140*a-b* can be a wire-wrapped screen having wire 144 wrapped about longitudinal ribs 144 running along a length of the basepipe 110*a-b*. The screens 140*a-b* filter fluid from the borehole directly to perforations or openings 118 in the basepipes 110*a-b* communicating with the basepipe's bores 112.

Between the end rings 120*a-b* and spanning across the blank area 106 of the coupling 104, the assembly 100 has a foil 150 covering the blank ends 114 of the basepipes 110*a-b* between the end rings 120*a-b* where the coupling member 116 connects the basepipes 110*a-b*. The foil 150 at least partially includes one or more screen sections 151*a-b*, which are shown here adjacent the end rings 120*a-b*. Other arrangements can be used.

As best shown in FIG. 10, these screen sections 151*a-b* can have ribs 152 with wire 154 wrapped thereabout, although other forms of filters or screens can be used. Additionally, both ends of the foil 150 may not require a screen section 151*a-b* as shown. Instead, one screen section 151 may be provided at one end or elsewhere along the foil 150. Additionally, more screen sections 151 can be provided on the foil 150. In fact, the entire foil 150 may constitute a screen section.

The foil 150 provides a leak-off path for the assembly 100 when used in gravel pack and frac pack operations. The foil 150 forms a tubular leak-off sleeve affixed after the basepipe connections 104 are made up between the adjoining screen sections 102*a-b*. Either one or both of the end rings 120*a-b* may have passages or flutes 123*b* at the basepipe 110*a-b* for fluid to pass from inside the leak-off foil 150 to underneath the screen 140*a-b* and eventual passage through the basepipes' perforations 118 and up the bores 112. In any event, the handling portions of both basepipes 110*a-b* in the blank area 106 can be perforated for fluid to enter the bores 112 directly through perforations 118. The coupling member 116 may be a flush joint and may have openings or perforations 118 for passage of the leak-off fluid directly into the basepipes' bores 112. The foil 150 provides a leak-off path for the fluid to flow through the perforations 118 in the basepipes 110*a-b* and the coupling member 116 at the blank area 106.

Figure 11:
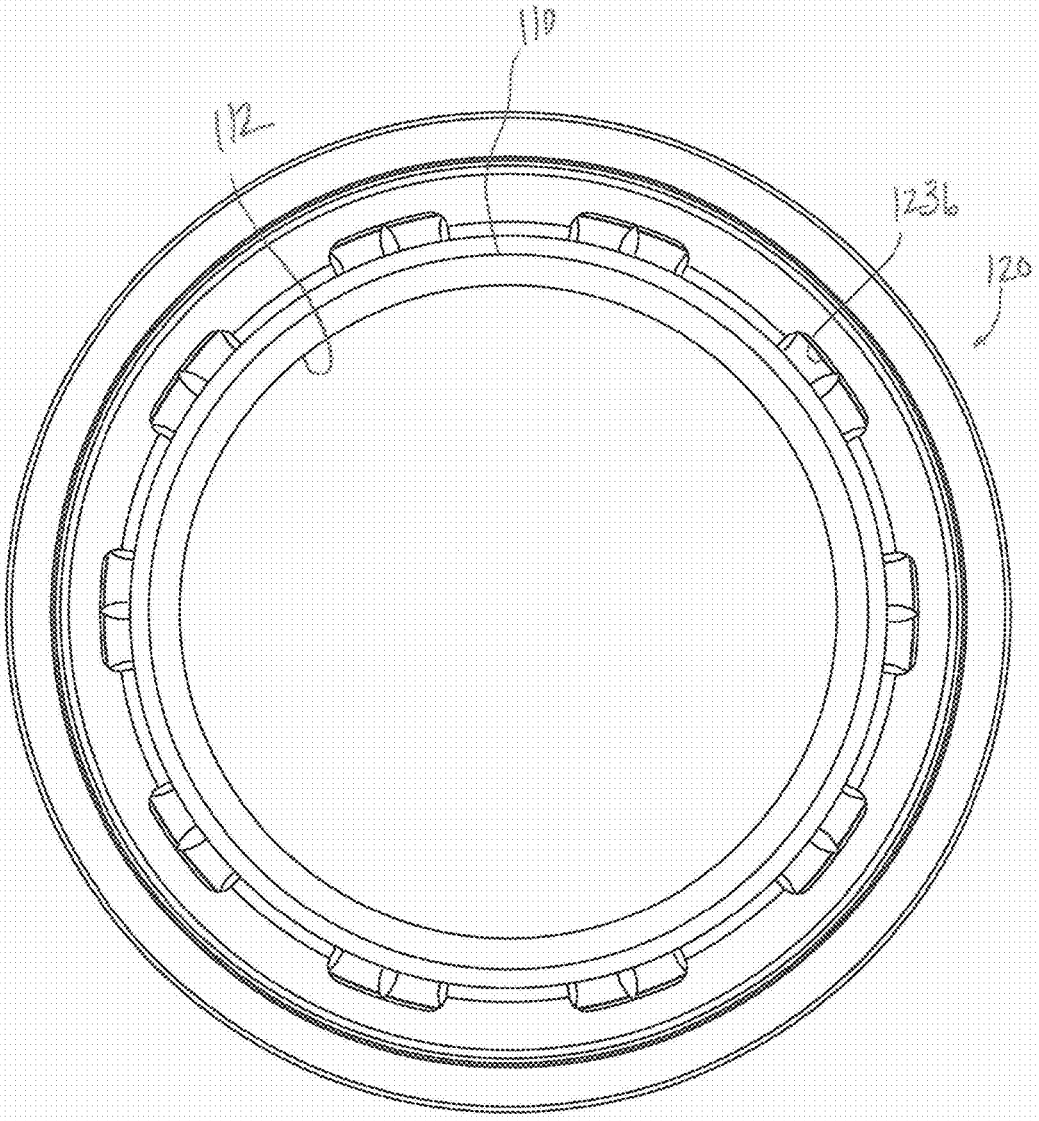
FIG. 11 is an end-view of an end ring disposed on a basepipe for the third assembly.

In particular, the foil 150 with its screen sections 151*a-b* leaks (and filters) fluid flow from outside the assembly 100 to inside the blank area 106 enclosed by the foil 150. Although the entire extent of the foil 150 may include such screen sections, this is not strictly necessary. Instead, the foil 150 can include an outer housing or sleeve 156 running along the majority of the foil 150. Either way, from inside the blank area 106, the leaked fluid can pass directly into the basepipes 110*a-b* through the perforations 118 in the blank area 106. Additionally, the leaked fluid may optionally travel through the ring's flutes 123*b* to a space between one or both of the screens 140*a-b* and respective basepipe 110*a-b* for indirect passage through the basepipe's perforation 118. (FIG. 11 is an end-view of an end ring 120 disposed on the basepipe 110 showing the slots or flutes 123).

To control leak-off and production, the screening provided by the foil 150 can be the same as or different from the screening provided by the joint's screens 140*a-b*, which are to be used for production. In this regard, the filter sections 151*a-b* of the foil 150 may be wire-wrapped screen or the like and may have gaps or slots to prevent passage of gravel. However, the size of the wire, the number of gaps, the number of slots, etc. may be less than used on the production screens 140*a-b*. Alternatively, the amount of surface area for screening provided by the foil 150 may be configured to be less than provided by the production screens 140*a-b*. In this way, using any of these various differences, the foil 150 can provide leak-off capabilities during gravel pack operations, but wellbore fluids would tend to flow more preferentially through the screens 140*a-b* during production operations due to the greater amount of open surface area of the screens 140*a-b*. Other configurations can be used and can be configured for a particular implementation.

Figure 12A:
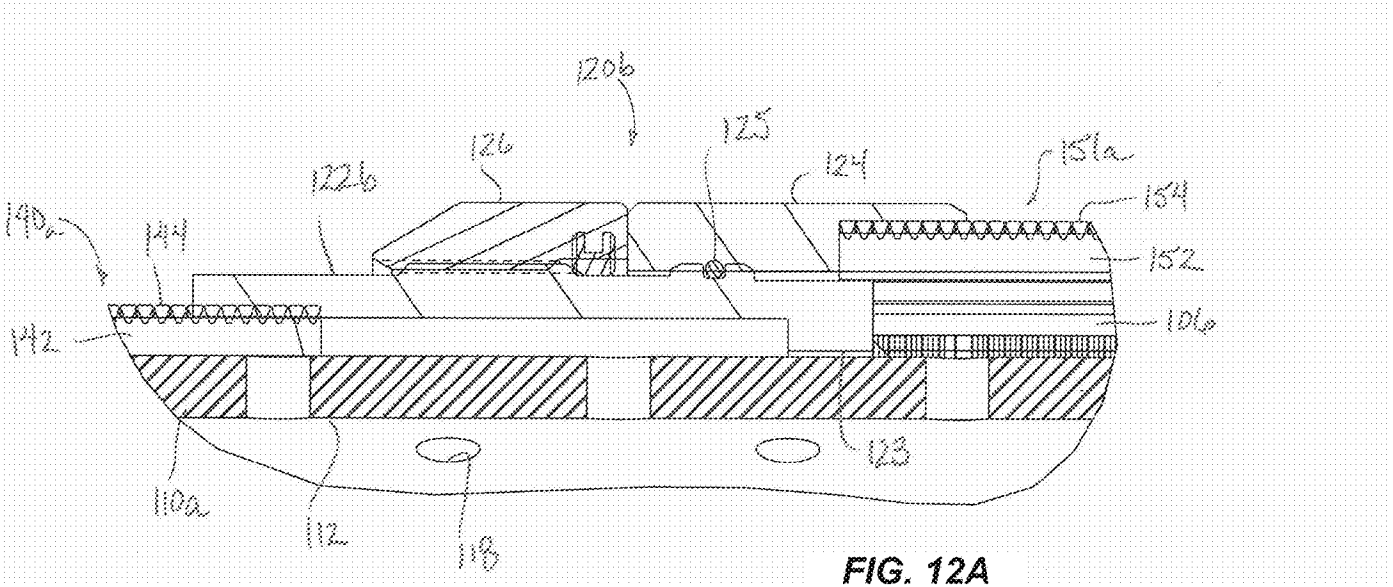
FIG. 12A is a detail of a first end ring and foil connection for the third assembly shown in cross-section.
Figure 12B:
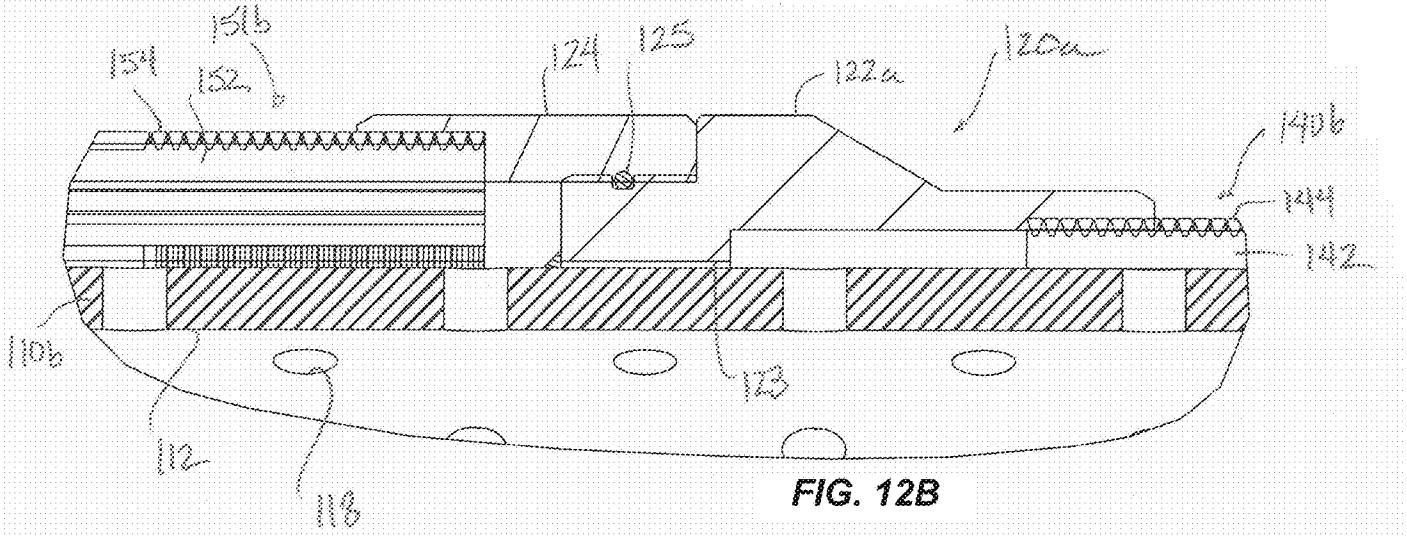
FIG. 12B is a detail of a second end ring and foil connection for the third assembly shown in cross-section.

One (lower) end ring 120*b* at one end of the blank area 106 is shown in FIG. 12A, while the other (upper) end ring 120*a* at the other end of the blank area 106 is shown in FIG. 12B. The lower end ring 120*b* as in FIG. 12A includes an end wall 122*b* disposed about the basepipe 110*a*. The end wall 122*b* may include inner slots or flutes 123*b* for passage of leaked fluid, although this is not strictly necessary. The end wall 122*b* overlaps portion of one of the screens 140*a*, fitting on a portion of the wire 144 and ribs 142. Fluid can pass through the screen section 151*a* into the blank area 106 enclosed by the foil 150 and can then pass directly into the basepipes 110*a-b* through the perforations 118 in the blank area 106 enclosed by the foil 150. As an additional option, the fluid in the blank area 106 can pass indirectly to a space between the screen 140*b* and the basepipe 110*a* via the inner slots or flutes 123*b* on the end ring 120*b*, although this is not strictly necessary.

To hold the end of the foil 150 on the end wall 122*b*, a retention ring 124 threads (or otherwise affixes) onto the end wall 122*b* and seals with a seal 125. An end of the retention ring 124 fits over the screen section 151*a* of the foil 150. The retention ring 124 is held tight against the foil 150 using a securing ring 126 that threads (or otherwise affixes) onto the other end of the end wall 122*b* and abuts the retention ring 124.

As shown in FIG. 12B, the upper end ring 120*a* at the other end of the blank area 106 is similar to the lower end ring 120*b*. This upper end ring 120*a* includes an end wall 122*a* disposed about the basepipe 110*b*. To hold the end of the foil 150 on this end wall 122*a*, a retention ring 124 threads (or otherwise affixes) onto the end wall 122*a* and seals thereagainst with a seal 125.

Again, the end wall 122*a* can include inner slots or flutes 123*b* for passage of fluid, although this is not strictly necessary. The end wall 122*a* overlaps portion of the other screen 140*b*, fitting on a portion of the wire 144 and ribs 142. Fluid can pass through the screen section 151*b* into the foil 150 and can then pass directly into the basepipes 110*a-b* through the perforations 118 at the blank area 106. As an additional option, the fluid in the blank area 106 can pass indirectly to a space between the screen 140*a* and the basepipe 110*b* via the inner slots or flutes 123*b* on the end ring 120*a*, although this is not strictly necessary.

Figure 13:
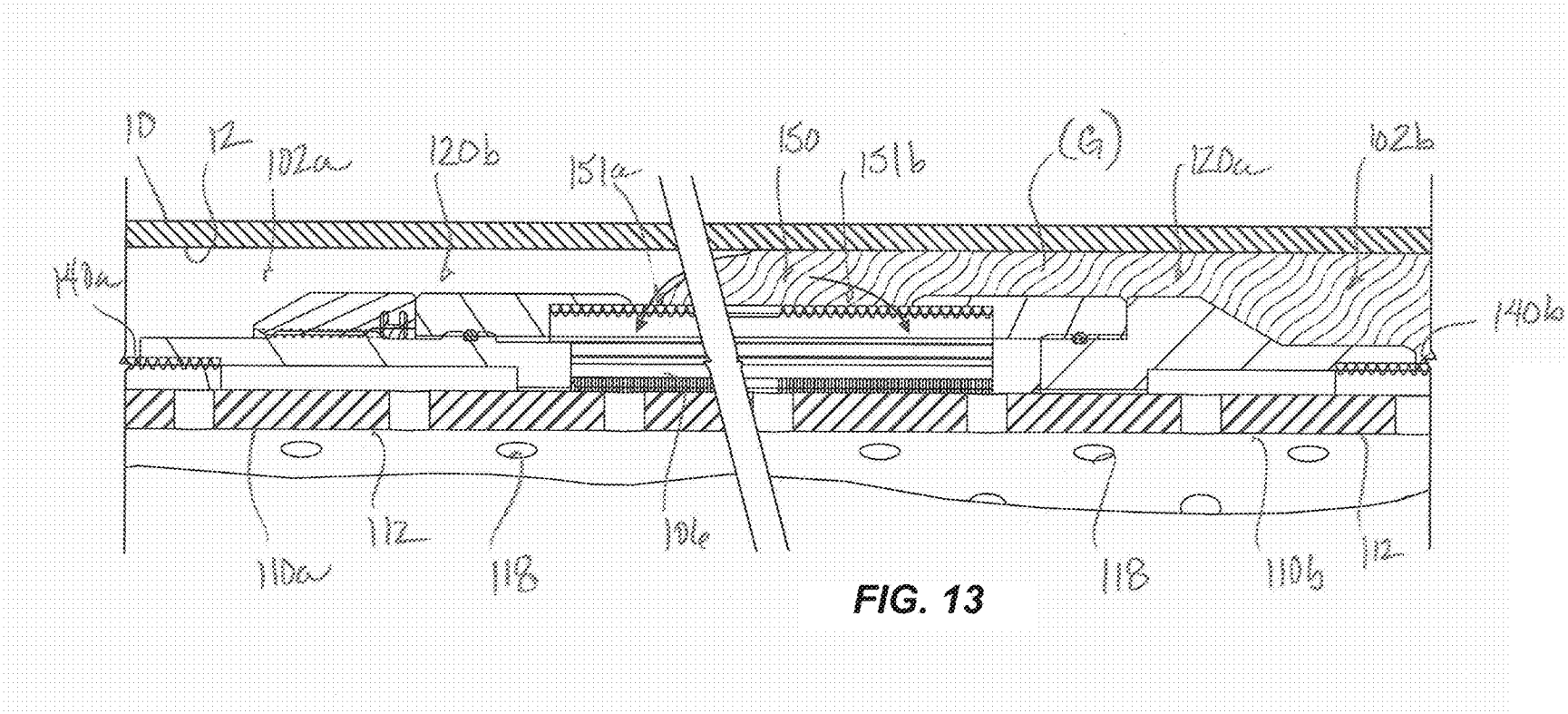
FIG. 13 illustrates the third assembly disposed in a cased hole with gravel packed in the annulus.

FIG. 13 illustrates the disclosed assembly 100 disposed in a cased hole 10 with gravel packed in the annulus. Gravel, proppant, or the like (G) is being packed in the annulus 12 between the assembly 100 and the casing 10. As the slurry travels in the annulus, the return fluid leaks off through the screens 140*a-b* to pack the gravel G about the screens 140*a-b*.

As shown, the foil 150 covers the blank connection between the basepipes 110*a-b*. The foil 150 provides a positive seal to both ends of the screens 140*a-b* and provides a surface to hold or retain the gravel G in the annular space 12 between the foil 150 and the casing 10. Internally, the foil 150 provides an open area 106 with minimal pressure drop to allow fluid to pass by the foil 150 and directly into the basepipe 110*a-b* through the perforations 118 enclosed in the blank area 106.

The assembly 100 provides more open area for the gravel G to dehydrate. Additionally, the foil 150 provides an external tubular wall on the assembly 100 that can help the gravel packing to be more uniform at the coupling 104. This external tubular wall of the foil 150 may be concentric or eccentric to the screens 140 and to the surrounding casing 10. Either way, the external tubular wall of the foil 150 provides a consistent annular space 12 to fill with gravel G with reduced variations that could cause premature bridging in the casing 10. In this way, the foil 150 provides a secondary sand control function for the standard screens 140*a-b*.

During operations to make up the toolstring and run the third assembly 100 of FIGS. 9-13 downhole, operators connect the upper basepipe 110*a* to the lower basepipe 110*b*, which already have the screens 140*a-b* and end rings 120*a-b*. Operators make up the coupling 104 by connecting the ends 114 of the basepipes 110*a-b* together with the coupling member 116 using the blank portions of the basepipes 110*a-b* for handling.

Operators then slide the foil 150, which was been held over the upper screen 140*a* on the upper basepipe 110*a*, down over the coupling 104 to enclose the blank area 106. The lower end of the foil 150 engages the upper end ring 120*a* of the lower joint 102*b* and seals therewith. Operators then affix the upper end of the foil 150 in place with the retention ring 126 on the lower end ring 120*b* of the upper joint 102*a*. The next and subsequent couplings 104 between joints 102 for the completion string can then be made up and run in the same way.

Figure 14A:
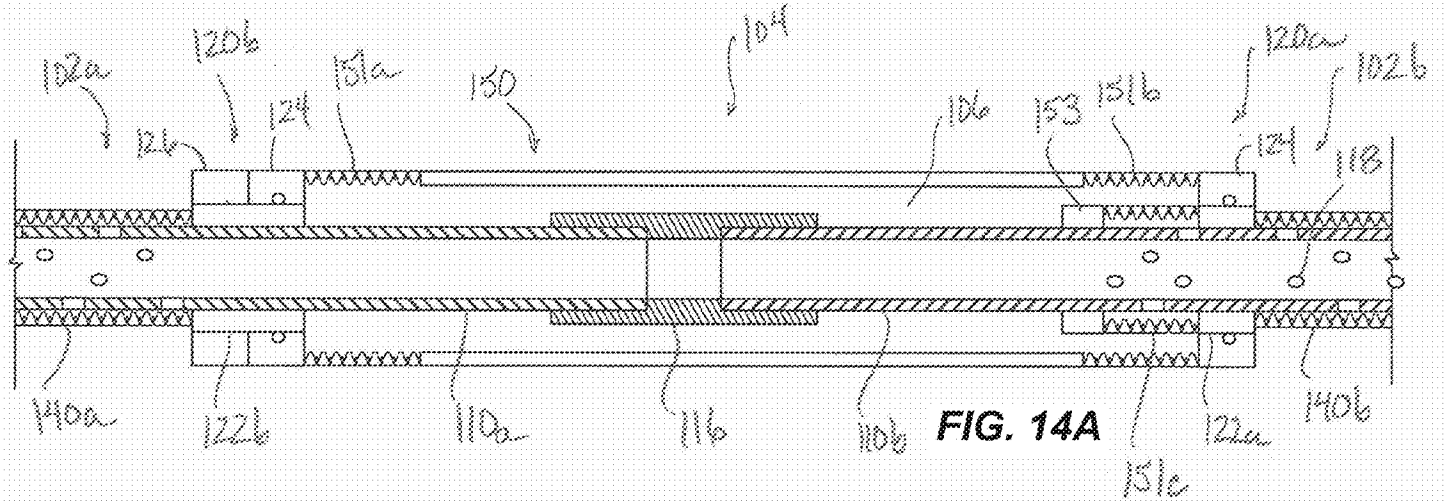
FIG. 14A illustrates a wellscreen assembly according to a fourth embodiment of the present disclosure having a dedicated screen in the blank area enclosed by the foil.
Figure 14B:
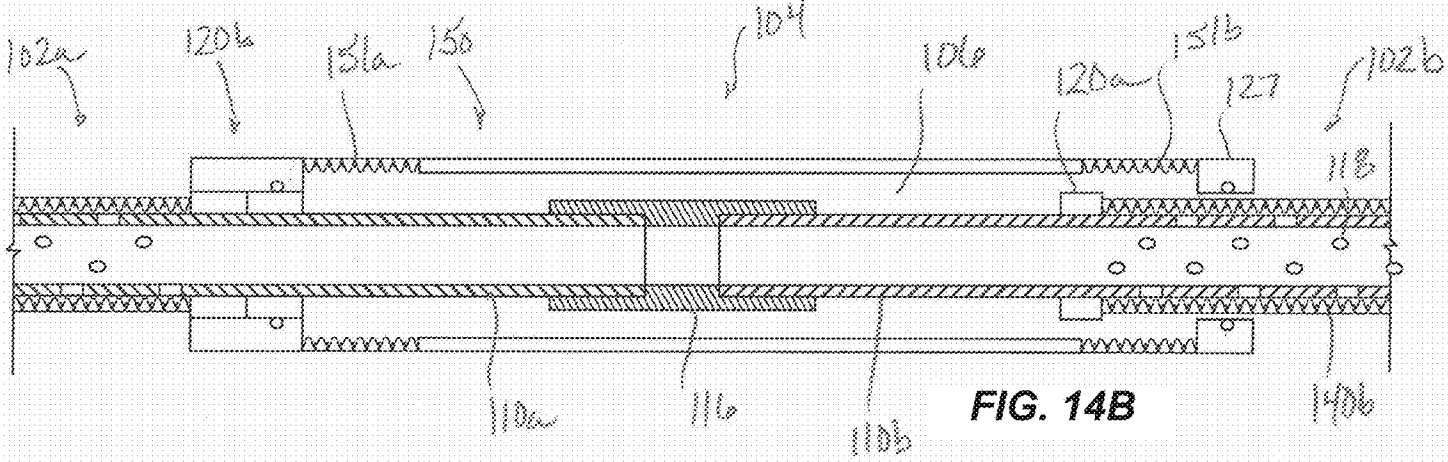
FIG. 14B illustrates a wellscreen assembly according to a fifth embodiment of the present disclosure having a portion of one of the screen sections enclosed in the blank area by the foil.

FIGS. 14A-14B show alternate embodiments of the wellscreen assembly 100 having a foil 150 and leak-off path according to the present disclosure. Similar reference numbers are used for comparable components to other embodiments, and description of these may not be repeated here. In the fourth assembly 100 of FIG. 14A, the foil 150 covers the coupling 104 over the blank area 106 between the adjoining screens 140*a-b* on the connected basepipes 110*a-b*. Although the foil 150 can include screen sections 151*a-b* as shown, the foil 150 can be a slotted sleeve, a perforated sleeve, a shroud, or the like.

Overall, the foil 150 may not need to act as a filter in this embodiment because the basepipes 110*a-b* lack perforations 118 exposed in the blank area 106. Instead, the foil 150 can have a number of general openings, slots, or the like to allow passage of leak off fluid without providing considerable filtering. Additionally, a dedicated leak-off screen 151*c* is provided on one or both of the basepipes (e.g., 110*b*) near perforations 118 enclosed inside the blank area 106 by the foil 150 and end rings 120*a-b*. During gravel or fracturing packing, slurry can pass through the foil 150 (i.e., through its course slots, holes, etc. if not acting as a filter). Leak-off fluid can then pass through the dedicated screen 151*c* into the perforations 118 of one or both of the basepipes (e.g., 110*b*) to return with the fluid returns. The slurry collecting in the blank area 106 can then dehydrate, providing a more uniform gravel pack at the coupling 104 between screen sections 102*a-b*.

The foil 150 during assembly steps is held along the upper screen 140*a* on the upper joint 102*a* and slides down into place over the blank area 106 once the basepipes 110*a-b* have been coupled together. The lower end of the foil 150 seals with the upper end ring 120*a* on the lower joint 102*b* and may use an end wall 122*a*, a securing ring 124, a retention ring 126, and an O-ring or other seal. At the lower end ring 120*b* on the upper screen section 102*a*, the foil 150 can affix in place using a lock ring 126 on an end wall 122*b*, and a seal may be provided. The lower end ring 120*b* lacks annular communication between the blank area 106 inside the foil 150 and the upper screen 140*a*. However, the upper end ring 120*a* on the lower joint 102*b* may have such annular communication provided by flutes (not shown), slots, or the like. Either way, the dedicated leak-off jacket 151*c* inside the blank portion inside the foil 150 allows slurry in the blank section to dehydrate.

The fifth assembly in FIG. 14B has the foil 150 that slides over the blank portion and partially over one of the screens 140*b* of the joint 102*b*. The end rings 120*a-b* on the screen sections 102*a-b* lack communication of flow through slots or flutes. For leak-off, a portion of the foil 150 covers the lower screen 140*b* and provides a leak-off path for the fluid. An end ring 127 on the end of the foil 150 can fit on the outside of the lower screen 140*b* and can seal with a tight clearance, seal, or the like.

Figures 15A, 15B, 15C:
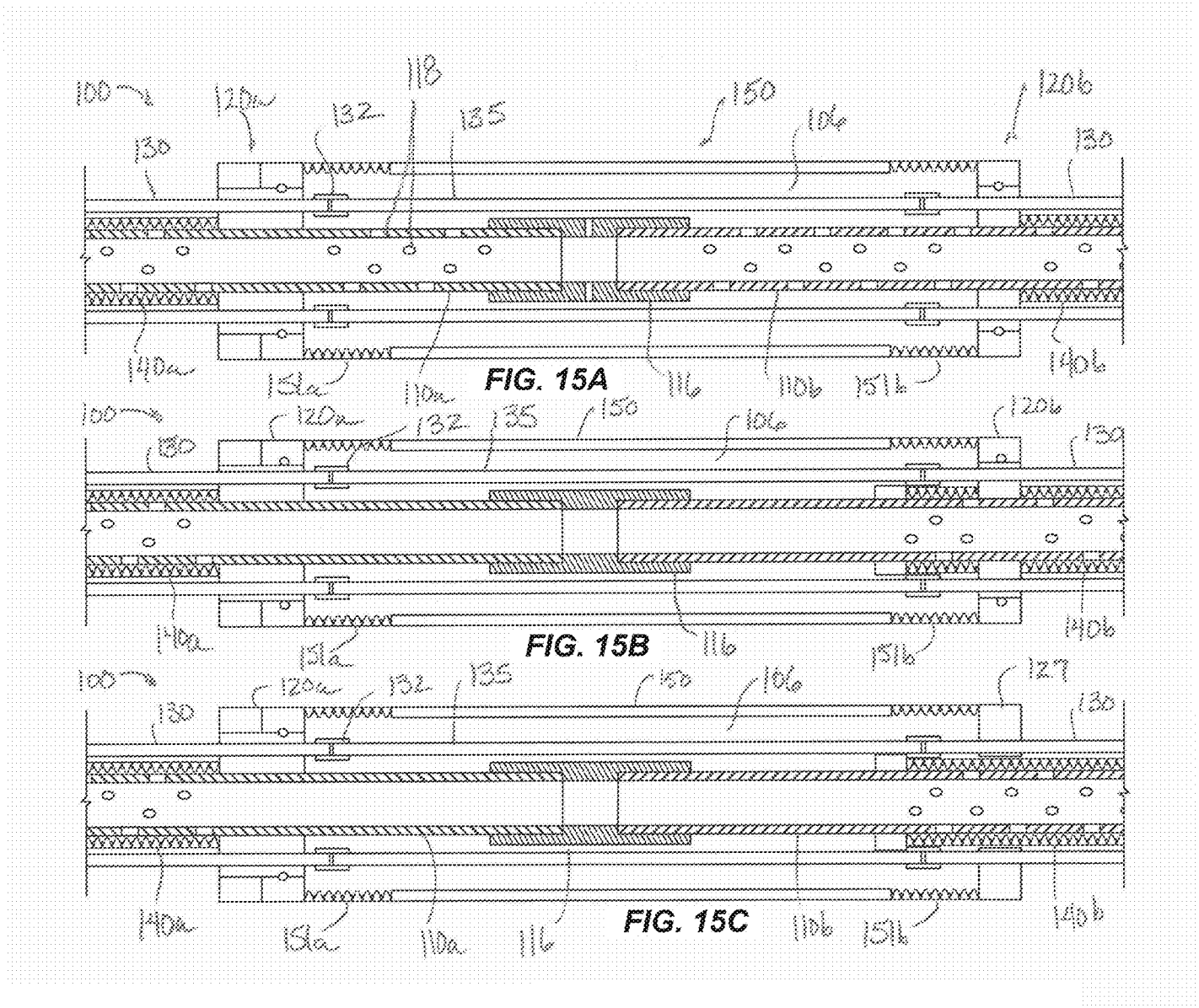
FIG. 15A illustrates a wellscreen assembly according to a sixth embodiment of the present disclosure having shunt tubes.
FIG. 15B illustrates a wellscreen assembly according to a seventh embodiment of the present disclosure having shunt tubes and having a dedicated screen in the blank area enclosed by the foil.
FIG. 15C illustrates a wellscreen assembly according to an eighth embodiment of the present disclosure having shunt tubes and having a portion of one of the screen sections enclosed in the blank area by the foil.

In previous embodiments, the wellscreen assemblies 100 lacked alternate flow paths through shunt or transport tubes. The foil 150 and leak-off according to the present disclosure can be used with the wellscreen assemblies 100 having such tubes for alternate flow paths. Turning then to FIGS. 15A-15C, embodiments of wellscreen assemblies 100 according to the present disclosure have shunt and jumper tubes 130 and 135. Again, the assemblies 100 have end rings 120*a-b* and foils 150. Additionally, the foils 150 can constitute an entire screen section or may comprise one or more screen sections. Similar reference numbers are used in FIGS. 15A-15C for comparable components to other embodiments, and description of these may not be repeated here.

In FIG. 15A, the sixth wellscreen assembly 100 is similar to that discussed above with respect to FIGS. 9 through 13. Here, the shunt or transport tubes 130 run along the length of the screen sections 140*a-b* and deliver or transport slurry in an alternate path during gravel pack or frack pack operations. The end rings 120*a-b* support the transport tubes 130 at the opposing ends of the screen sections 140*a-b* and hold the tubes 130 in place. Ends of the transport tubes 130 extend from the end rings 120*a-b*, and the jumper tubes 135 interconnect to the ends of the transport tubes 130 on the adjoining screen sections 140*a-b* across the coupling 104. Connectors 132 having seals 134 connect the ends of the jumper tube 135 with the ends of the transport tubes 130.

Figure 17:
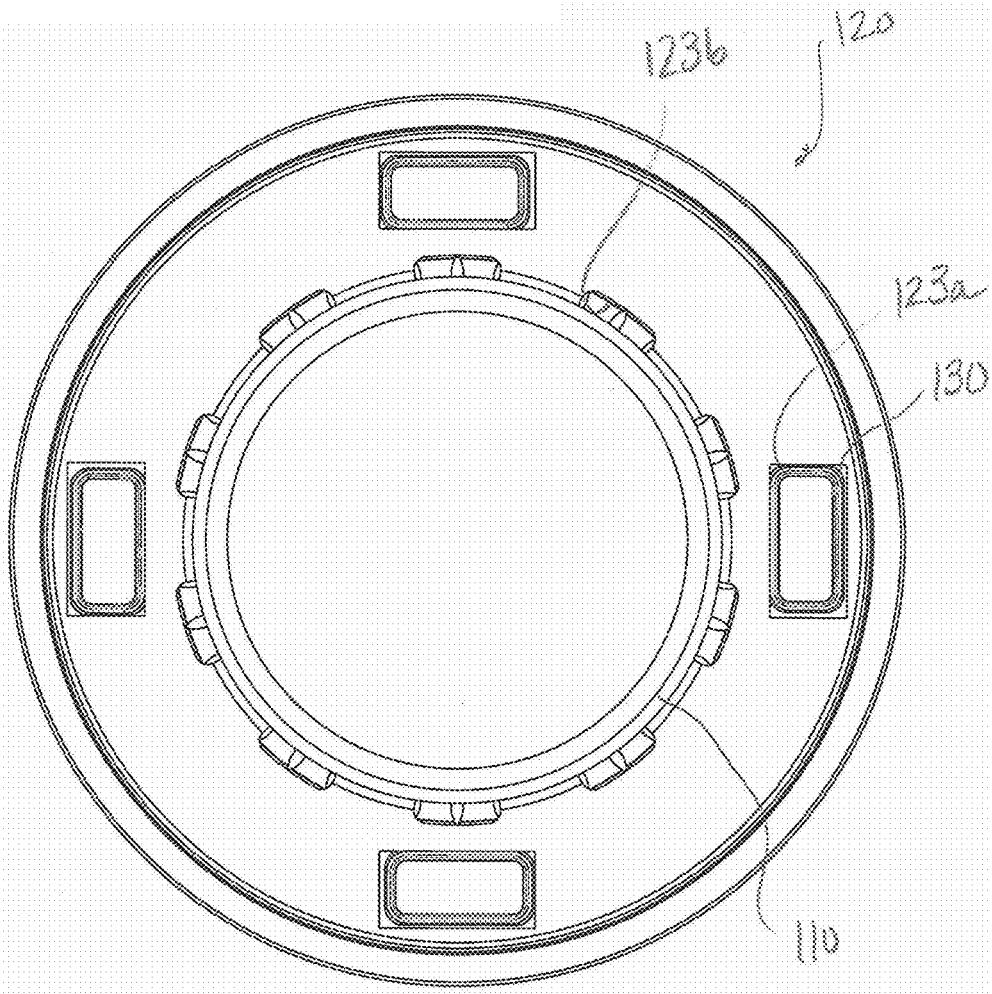
FIG. 17 is an end-view of an end ring disposed on a basepipe and having shunt tubes passing therein.

In general, the assembly 100 can have any number of transport tubes 130, and the tubes 130 can be used to deliver slurry out of nozzles (not shown) on the tubes 130 or may transport the slurry further along the assembly 100 to other locations. As shown in the end view of FIG. 17, for example, the end ring 120 can support a number (e.g., four) of the transport tubes 130 about the circumference of the basepipe 110. The openings 123*a* for tubes 130 may have seals (not shown), brazed material, tight clearance fits, or the like to prevent fluid communication.

Figure 16A:
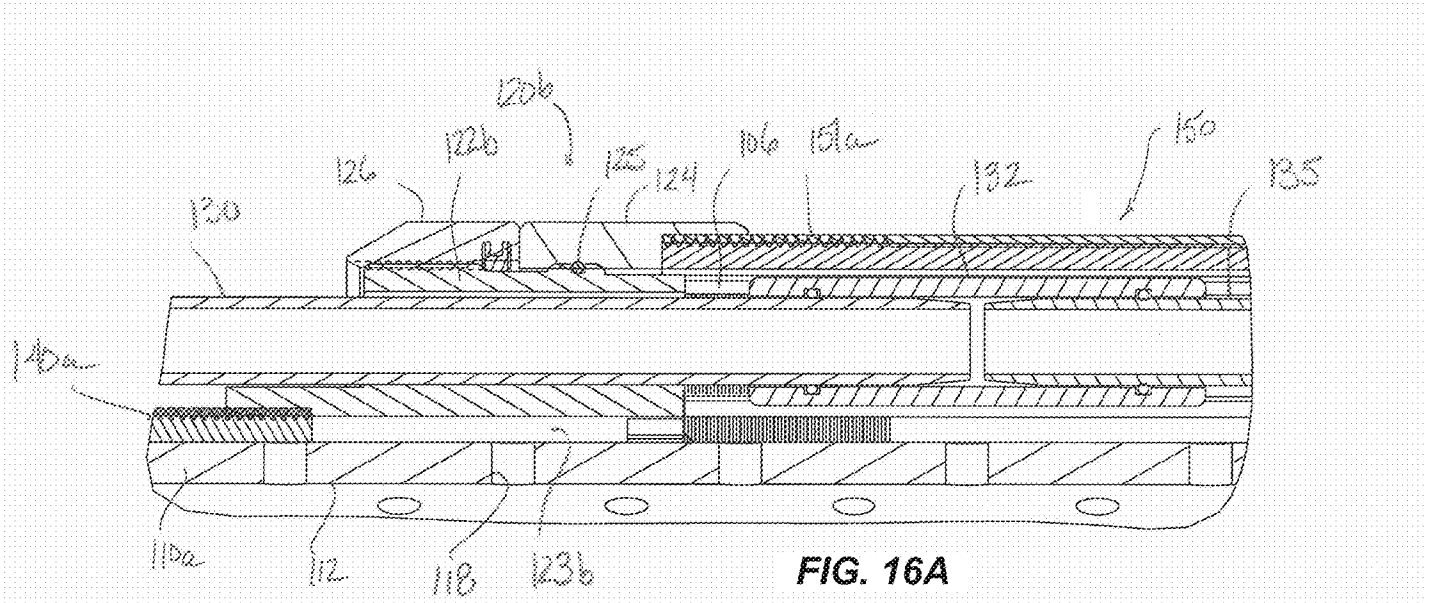
FIG. 16A is a detail of a first end ring and foil connection for the disclosed assembly of FIG. 15A shown in cross-section.
Figure 16B:
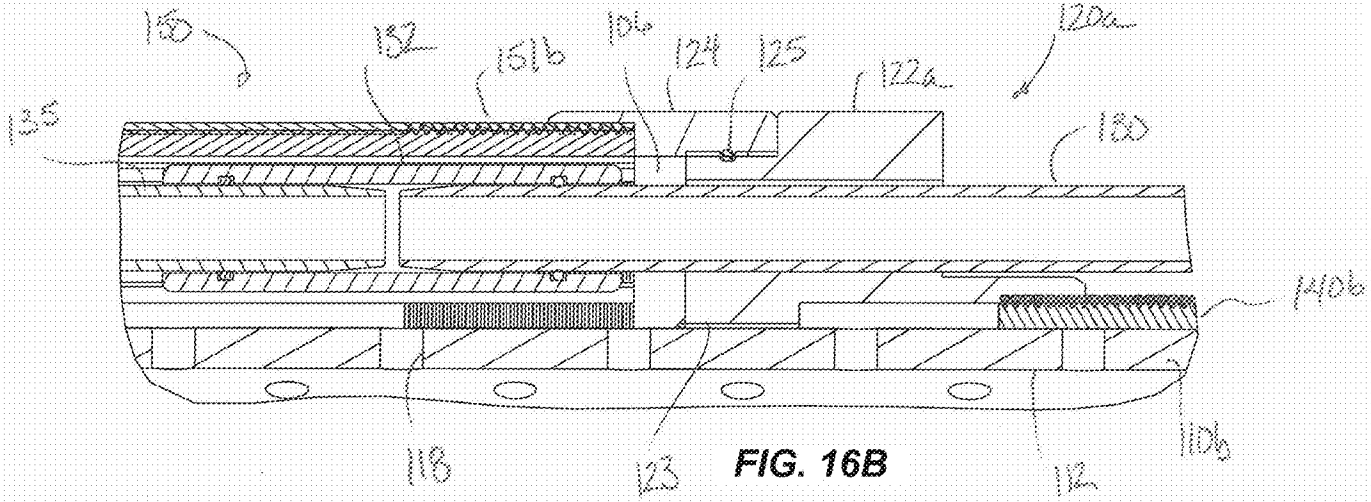
FIG. 16B is a detail of a second end ring and foil connection for the disclosed assembly of FIG. 15A shown in cross-section.

FIGS. 16A-16B show details of connections for the disclosed assembly 100 of FIG. 15A in cross-section. One (lower) end ring 120*b* at one end of the blank area 106 is shown in FIG. 16A, while the other (upper) end ring 120*a* at the other end of the blank area 106 is shown in FIG. 16B. The lower end ring 120*b* as in FIG. 16A includes an end wall 122*b* disposed about the basepipe 110*a*. The end wall 122*b* has openings 123*a* for passage of the ends of the transport tubes 130. The end wall 122*b* also includes inner slots or flutes 123*b* for passage of fluid, although this is not strictly necessary. The end wall 122*b* overlaps portion of one of the screens 140*a*, fitting on a portion of the wire 144 and ribs 142.

Fluid can pass through the screen section 151*a* of the foil 150 into the blank area 106 and can then pass directly into the basepipes 110*a-b* through the perforations 118 at the blank area 106. As an additional option, the fluid in the blank area 106 can pass indirectly to a space between the screen 140*b* and the basepipe 110*a* via the inner slots or flutes 123*b*, although this is not strictly necessary.

To hold the end of the foil 150 on the end wall 122*b*, a retention ring 124 threads (or otherwise affixes) onto the end wall 122*b* and seals with a seal 125. An end of the retention ring 124 fits over the screen section 151*a* of the foil 150. The retention ring 124 is then held tight against the foil 150 using a securing ring 126 that threads (or otherwise affixes) onto the other end of the end wall 122*b* and abuts the retention ring 124. Other forms of affixing the ring 126 can be used, including retaining screws, lock wires, etc.

As shown in FIG. 16B, the other upper end ring 120*a* at the other end of the blank area 106 is similar to the first end ring 120*b*. This upper end ring 120*a* includes an end wall 122*a* disposed about the basepipe 110*b*. To hold the end of the foil 150 on this end wall 122*a*, a retention ring 124 threads (or otherwise affixes) onto the end wall 122*a* and seals thereagainst with a seal 125.

The end wall 122*a* has openings 123*a* for passage of the opposite transport tubes 130. The end wall 122*a* can also include inner slots or flutes 123*b* for passage of fluid, although this is not strictly necessary. The end wall 122*a* overlaps portion of the other screen 140*b*, fitting on a portion of the wire 144 and ribs 142.

Fluid can pass through the screen section 151*b* into the blank area 106 enclosed by the foil 150 and can then pass directly into the basepipes 110*a-b* through the perforations 118 at the blank area 106. As an additional option, the fluid in the blank area 106 can pass indirectly to a space between screen 140*a* and the basepipe 110*b* via the inner flutes 123*b*, although this is not strictly necessary.

FIGS. 15B-15C show alternate embodiments of the wellscreen assembly 100 having foils 150 and leak-off paths according to the present disclosure. These assemblies 100 are similar to those discussed above with reference to FIGS. 14A-14B; however, the assemblies 100 further include shunt and jumper tubes 130 and 135. The same explanations provided previously apply equally with reference to the assemblies 100 of FIGS. 15B-15C.

Reference to gravel packing herein may equally refer to frack packing. Use of the terms such as screen and filter may be used interchangeably herein. The foregoing description of preferred and other embodiments is not intended to limit or restrict the scope or applicability of the inventive concepts conceived of by the Applicants. For example, although the assemblies 100 disclosed herein have shown use of shunt tubes, it will be appreciated that the foil 150 and end rings 120 can be used on assemblies lacking shunt tubes and jumper tubes. It will also be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for a borehole, the assembly comprising:

tubing having a bore and having first and second joints coupled together at first and second ends;

a first filter disposed on the first joint and filtering fluid passage from the borehole into the bore;

a second filter disposed on the second joint and filtering fluid passage from the borehole into the bore;

first and second rings respectively disposed on the first and second ends and respectively securing the first and second filters to the first and second joints, at least one of the first and second end rings defining at least one passage communicating a blank area between the first and second rings with a space between the respective filter and the respective joint;

a foil abutting the first and second end rings of the first and second filters and enclosing the blank area across the first and second coupled ends, the foil having an external surface defining an annulus thereabout with the borehole and at least leaking fluid from the borehole to the blank area enclosed by the foil; and a filter portion of the assembly filtering the leaked fluid of the blank area, wherein the leaked fluid of the blank area communicates through the at least one passage in the at least one first and second end ring, to the space between the respective filter and the respective joint, and to the bore of the tubing.

2. The assembly of claim 1, further comprising one or more transport tubes disposed along the tubing.

3. The assembly of claim 2, wherein the one or more transport tubes comprise:

a first transport tube disposed along the first joint;

a second transport tube disposed along the second joint; and a jumper tube disposed inside the blank area enclosed by the foil and connecting the first and second transport tubes together.

4. The assembly of claim 2, wherein the first end ring and the second end ring each defines one or more openings passing ends of the one or more transport tubes therethrough.

5. The assembly of claim 1, wherein the first joint comprises a first basepipe having the first filter disposed thereon, the first basepipe having one or more first perforations communicating the bore with the first filter; and wherein the second joint comprises a second basepipe having the second filter disposed thereon, the second basepipe having one or more second perforations communicating the bore with the second filter.

6. The assembly of claim 1, wherein both of the first end ring and the second end ring each defines the at least one passage communicating the fluid from the blank area to the space between the respective filter and the respective joint.

7. The assembly of claim 1, wherein the first filter comprises a first screen disposed on the first joint, and wherein the second filter comprises a second screen disposed on the second joint.

8. The assembly of claim 1, wherein the first and second filters filter returns from slurry in the borehole and hold gravel from the slurry in the annulus, and wherein the external surface of the foil provides a uniform outer dimension against which the gravel can be held in the annulus.

9. The assembly of claim 1, wherein the filter portion of the assembly comprises a screen on at least a portion of the foil and filtering the fluid leaked from the borehole into the blank area enclosed by the foil.

10. The assembly of claim 1, wherein the foil encloses one or more perforations on at least the first end of the first joint; and wherein the filter portion of the assembly filters the leaked fluid of the blank area directly to the one or more perforations.

11. The assembly of claim 10, wherein the filter portion of the assembly comprises a screen on at least a portion of the foil filtering the fluid leaked from the borehole into the blank area enclosed by the foil.

12. The assembly of claim 10, wherein the filter portion of the assembly comprises a third filter disposed in the blank area on at least the first end and filtering the leaked fluid from the blank area directly to the one or more perforations defined in the first end.

13. The assembly of claim 10, wherein the filter portion of the assembly comprises a part of the first filter enclosed in the blank area by the foil, the part of the first filter filtering the leaked fluid from the blank area directly to the one or more perforations defined in the first end of the first joint.

14. A method of assembling an assembly for a borehole, the method comprising:

slipping a foil on a first end of a first joint by at least partially passing the foil over a first end ring securing a first filter on the first joint;

assembling tubing by connecting the first end of the first joint to a second end of a second joint, the second joint having a second end ring securing a second filter on the second joint;

enclosing a blank area across the first and second connected ends by fitting the foil over the first and second connected ends;

abutting a first portion of the foil against the first end ring of the first filter on the first joint;

abutting a second portion of the foil against the second end ring of the second filter on the second joint;

securing at least one of the first and second portions of the foil to at least one of the first and second end rings;

permitting fluid communication from outside the foil through a section of the foil to the blank area enclosed by the foil; and permitting filtering of the fluid communication from the blank area to a bore of the tubing.

15. The method of claim 14, wherein enclosing the blank area comprises enclosing one or more perforations in the first connected end.

16. The method of claim 15, wherein before enclosing the one or more perforations, the method comprises positioning a portion of the first filter on the first end over the one or more perforations.

17. The method of claim 15, wherein before enclosing the one or more perforations, the method comprises positioning a third filter on the first end over the one or more perforations.

18. The method of claim 14, wherein securing the at least one portion of the foil to the at least one end ring comprises engaging a retention ring on one end of the foil on the at least one end ring.

19. The method of claim 18, wherein engaging the retention ring comprises fitting, threading, sealing, and/or welding the retention ring onto the at least one end ring.

20. The method of claim 14, wherein securing the at least one portion of the foil to the at least one end ring comprises:

engaging a retention ring on one end of the foil on the at least one end ring; and affixing a securing ring on the at least one end ring against the retention ring.

21. The method of claim 20, wherein engaging the retention ring comprises fitting, threading, and/or sealing the retention ring on the at least one end ring; and wherein affixing the securing ring comprise threading the securing ring on the at least one end ring against the retention ring.

22. A method of gravel packing a borehole, the method comprising:

conducting slurry in an annulus of a borehole around tubing having first and second joints coupled together at first and second ends;

filtering fluid from the slurry in the borehole to a bore of the tubing through first and second filters disposed on the first and second joints, the first and second filters secured respectively to the first and second joints with first and second end rings;

foiling the slurry in the annulus around a foil extending across a blank area between the first and second coupled ends;

leaking the fluid from the slurry in the borehole through the foil and into the blank area;

communicating the fluid in the blank area to at least one space between at least one of the first and second filters and the respective joint via at least one passage in the respective end ring; and filtering the fluid from the blank area to the bore of the tubing.

23. The method of claim 22, wherein filtering the fluid from the blank area to the bore of the tubing comprises communicating the fluid from the blank area to the at least one space between the respective filter and the respective joint.

24. The method of claim 22, wherein filtering the fluid from the blank area to the bore of the tubing comprises communicating the fluid from the blank area to one or more perforations in at least one of the first and second ends enclosed by the foil.

25. The method of claim 24, wherein communicating the fluid from the blank area to the one or more perforations in the first end enclosed by the foil comprises filtering the fluid in the blank area through a portion of at least one of the first and second filters in the blank area disposed on the one or more perforations.

26. The method of claim 24, wherein communicating the fluid from the blank area to the one or more perforations in the first end enclosed by the foil comprises filtering the fluid into the blank area through a portion of the foil.

27. The method of claim 24, wherein communicating the fluid from the blank area to the one or more perforations in the first end enclosed by the foil comprises filtering the fluid in the blank area through a third filter in the blank area disposed on the one or more perforations.

* * * * *